US006259464B1

(12) United States Patent
Suzuki et al.

(10) Patent No.: US 6,259,464 B1
(45) Date of Patent: Jul. 10, 2001

(54) IMAGE-FORMING SUBSTRATE AND IMAGE-FORMING APPARATUS USING SAME

(75) Inventors: Minoru Suzuki, Tochigi; Hiroshi Orita; Hiroyuki Saito, both of Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/261,232

(22) Filed: Mar. 3, 1999

(30) Foreign Application Priority Data

Mar. 4, 1998 (JP) ..... 10-069452

(51) Int. Cl.[7] ..... B41J 2/325

(52) U.S. Cl. ..... 347/172

(58) Field of Search ..... 349/221, 212, 349/172, 173; 400/241.2, 120.01, 120.02, 124.08, 124.09, 124.1, 149, 82; 428/321.5; B41J 2/32, 2/335, 2/325; B41M 3/28

(56) References Cited

U.S. PATENT DOCUMENTS 5,015,552 * 5/1991 Tamura et al. ..... 347/172

* cited by examiner

*Primary Examiner*—N. Le
*Assistant Examiner*—K. Feggins
(74) *Attorney, Agent, or Firm*—Greenblum & Bernstein, P.L.C.

(57) ABSTRACT

An image-forming substrate has a base member, and a layer of microcapsules coated over the base member. The microcapsule layer contains a first type of microcapsule filled with a first type of single-color dye, and a second type of microcapsule filled with a second type of single-color dye. The first and second types of single-color dyes comprise a same single-color dye exhibiting differing densities. The first type of microcapsule exhibits a first characteristic such that, when the first type of microcapsule is squashed under a first pressure at a first temperature, discharge of the first type of single-color dye from the squashed microcapsule occurs. The second type of microcapsule exhibits a second characteristic such that, when the second type of microcapsule is squashed under the first pressure at a second temperature, discharge of the second type of single-color dye from the squashed microcapsule occurs.

24 Claims, 20 Drawing Sheets

| IMAGE-PIXEL SIGNAL "Y" | 2-BIT GRADATION SIGNAL "GSY" | PULSE WIDTH OF CONTROL SIGNAL "DAY" |
|---|---|---|
| [0] | [00] | (LOW-LEVEL) |
| [1] | [01] | $PWY_1$ |
| [1] | [10] | $PWY_2$ |

| IMAGE-PIXEL SIGNAL "M" | 2-BIT GRADATION SIGNAL "GSM" | PULSE WIDTH OF CONTROL SIGNAL "DAM" |
|---|---|---|
| [0] | [00] | (LOW-LEVEL) |
| [1] | [01] | $PWM_1$ |
| [1] | [10] | $PWM_2$ |

| IMAGE-PIXEL SIGNAL "C" | 2-BIT GRADATION SIGNAL "GSC" | PULSE WIDTH OF CONTROL SIGNAL "DAC" |
|---|---|---|
| [0] | [00] | (LOW-LEVEL) |
| [1] | [01] | $PWC_1$ |
| [1] | [10] | $PWC_2$ |

| IMAGE-PIXEL SIGNAL "Y" | 2-BIT GRADATION SIGNAL "GSY" | LEVEL OF CONTROL SIGNAL "$DAY_1$" | LEVEL OF CONTROL SIGNAL "$DAY_2$" |
|---|---|---|---|
| [0] | [00] | L | L |
| [1] | [01] | H | L |
| [1] | [10] | L | H |
| [1] | [11] | H | H |

| IMAGE-PIXEL SIGNAL "M" | 2-BIT GRADATION SIGNAL "GSM" | LEVEL OF CONTROL SIGNAL "$DAM_1$" | LEVEL OF CONTROL SIGNAL "$DAM_2$" |
|---|---|---|---|
| [0] | [00] | L | L |
| [1] | [01] | H | L |
| [1] | [10] | L | H |
| [1] | [11] | H | H |

| IMAGE-PIXEL SIGNAL "C" | 2-BIT GRADATION SIGNAL "GSC" | LEVEL OF CONTROL SIGNAL "$DAC_1$" | LEVEL OF CONTROL SIGNAL "$DAC_2$" |
|---|---|---|---|
| [0] | [00] | L | L |
| [1] | [01] | H | L |
| [1] | [10] | L | H |
| [1] | [11] | H | H |

IMAGE-FORMING SUBSTRATE AND IMAGE-FORMING APPARATUS USING SAME

BACKGROUND OF THE INVENTION

1. Field of the Invention

The present invention relates to an image-forming substrate coated with a layer of microcapsules filled with dye or ink, on which an image is formed by selectively squashing or breaking microcapsules in the layer of microcapsules, and also relates an image-forming apparatus using such an image-forming substrate.

2. Description of the Related Art

In a conventional type of image-forming substrate coated with a layer of microcapsules filled with dye or ink, a shell of each microcapsule is formed from a suitable photo-setting resin, and an optical image is recorded and formed as a latent image on the layer of microcapsules by exposing it to light rays in accordance with image-pixel signals. Then, the latent image is developed by exerting a pressure on the layer of microcapsules. Namely, the microcapsules, which are not exposed to the light rays, are broken, whereby the dye or ink is discharged from the broken microcapsules, and thus the latent image is visually developed by the discharging of the dye or ink.

The formation of the image on the layer of microcapsules is performed by producing image-pixel dots in accordance with image-pixel signals. Each of the image-pixel dots has a larger diameter than that of the microcapsules, and thus plural microcapsules are included in each image-pixel dot area. Each of the image-pixel dots is developed or colored by breaking the microcapsules included in the corresponding image-pixel dot area, and the colored image-pixel dot merely exhibits a given constant density. Namely, it is unknown to vary a density of the colored image-pixel dot per se.

Also, each of the conventional image-forming substrates must be packed so as to be protected from being exposed to light, resulting in a wastage of materials. Further, the image-forming substrates must be handled such that they are not subjected to excess pressure due to the softness of unexposed microcapsules, resulting in an undesired discharging of the dye or ink.

SUMMARY OF THE INVENTION

Therefore, an object of the present invention is to provide an image-forming substrate coated with a layer of microcapsules filled with dye or ink, wherein it is possible to vary a density of an image-pixel dot per se, which is to be produced and colored on the image-forming substrate by selectively squashing and breaking the microcapsules included in a corresponding image-dot area.

Also, another object of the present invention is to provide an image-forming apparatus using such an image-forming substrate.

In accordance with a first aspect of the present invention, there is provided an image-forming substrate which comprises a base member, and a layer of microcapsules, coated over the base member, containing a first type of microcapsule filled with a first type of first-single-color dye, and a second type of microcapsule filled with a second type of first-single-color dye. The first type of microcapsule exhibits a first temperature/pressure characteristic such that, when the first type of microcapsule is squashed under a first predetermined pressure at a first predetermined temperature, discharge of the first type of first-single-color dye from the squashed microcapsule occurs. The second type of microcapsule exhibits a second temperature/pressure characteristic such that, when the second type of microcapsule is squashed under the first predetermined pressure at a second predetermined temperature, discharge of the second type of first-single-color dye from the squashed microcapsule occurs.

According to the first aspect of the present invention, to form an image on the image-forming substrate featuring the first and second types of microcapsules, there is provided an image-forming apparatus which comprises a pressure applicator that exerts the first predetermined pressure on the image-forming substrate, and a thermal heater that selectively heats a localized area, on which the first predetermined pressure is exerted by the first pressure applicator, to one of the first predetermined temperature and the second predetermined temperature in accordance with image-pixel information carrying gradation information.

In the first aspect of the present invention, the layer of microcapsules also may comprise a third type of microcapsule filled with a first type of second-single-color dye, and a fourth type of microcapsule filled with a second type of second-single-color dye. The third type of microcapsule exhibits a third temperature/pressure characteristic such that, when the third type of microcapsule is squashed under a second predetermined pressure at a third predetermined temperature, discharge of the first type of second-single-color dye from the squashed microcapsule occurs. The fourth type of microcapsule exhibits a fourth temperature/pressure characteristic such that, when the fourth type of microcapsule is squashed under the second predetermined pressure at a fourth predetermined temperature, discharge of the second type of second-single-color dye from the squashed microcapsule occurs.

According to the first aspect of the present invention, to form an image on the image-forming substrate featuring the first, second, third and fourth types of microcapsules, there is provided an image-forming apparatus which comprises a first pressure applicator that exerts the first predetermined pressure on the image-forming substrate, a second pressure applicator that exerts the second predetermined pressure on the image-forming substrate, a first thermal heater that selectively heats a localized area, on which the first predetermined pressure is exerted by the first pressure applicator, to one of the first predetermined temperature and the second predetermined temperature in accordance with first-single-color image-pixel information carrying gradation information, and a second thermal heater that selectively heats a localized area, on which the second predetermined pressure is exerted by the second pressure applicator, to one of the third predetermined temperature and the fourth predetermined temperature in accordance with second-single-color image-pixel information carrying gradation information.

In the first aspect of the present invention, the layer of microcapsules may further comprise a fifth type of microcapsule filled with a first type of third-single-color dye, and a sixth type of microcapsule filled with a second type of third-single-color dye. The fifth type of microcapsule exhibits a fifth temperature/pressure characteristic such that, when the fifth type of microcapsule is squashed under a third predetermined pressure at a fifth predetermined temperature, discharge of the first type of third-single-color dye from the squashed microcapsule occurs. The sixth type of microcapsule exhibits a sixth temperature/pressure characteristic such that, when the sixth type of microcapsule is squashed under the third predetermined pressure at a sixth predetermined temperature, discharge of the second type of third-single-color dye from the squashed microcapsule occurs.

According to the first aspect of the present invention, to form an image on the image-forming substrate featuring the first, second, third, fourth, fifth and sixth types of microcapsules, there is provided an image-forming apparatus which comprises a first pressure applicator that exerts the first predetermined pressure on the image-forming substrate, a second pressure applicator that exerts the second predetermined pressure on the image-forming substrate, a third pressure applicator that exerts the third predetermined pressure on the image-forming substrate, a first thermal heater that selectively heats a localized area, on which the first predetermined pressure is exerted by the first pressure applicator, to one of the first predetermined temperature and the second predetermined temperature in accordance with first-single-color image-pixel information carrying gradation information, a second thermal heater that selectively heats a localized area, on which the second predetermined pressure is exerted by the second pressure applicator, to one of the third predetermined temperature and the fourth predetermined temperature in accordance with second-single-color image-pixel information carrying gradation information; and a third thermal heater that selectively heats a localized area, on which the third predetermined pressure is exerted by the third pressure applicator, to one of the fifth predetermined temperature and the sixth predetermined temperature in accordance with third-single-color image-pixel information carrying gradation information.

In the first aspect of the present invention, the first and second types of first-single-color dyes may exhibit the same density or may exhibit different densities; the first and second types of second-single-color dyes may exhibit the same density or may exhibit different densities; and the first and second types of third-single-color dyes may exhibit the same density or may exhibit different densities. If necessary, the first-single-color dye, the second-single-color dye and the third-single-color dye may comprise a same single-color dye exhibiting differing densities.

Preferably, the first-single-color dye, the second-single-color dye and the third-single-color dye may comprise three-primary color dyes. In this case, the image-forming substrate may further comprise an additional layer of microcapsules filled with black dye coated over the layer of microcapsules, and the microcapsules, included in the additional layer of microcapsules, is formed of resin such that they are at least thermally plasticized at a greater temperature than the sixth predetermined temperature and under a lower pressure than the third predetermined pressure.

In accordance with a second aspect of the present invention, there is provided an image-forming substrate which comprises a base member, and a layer of microcapsules, coated over the base member, containing a first type of microcapsule filled with a first type of first-single-color dye, and a second type of microcapsule filled with a first type of first-single-color dye. The first type of microcapsule exhibits a first temperature/pressure characteristic such that, when the first type of microcapsule is squashed under a first predetermined pressure at a first predetermined temperature, discharge of the first type of first-single-color dye from the squashed microcapsule occurs. The second type of microcapsule exhibits a second temperature/pressure characteristic such that, when the second type of microcapsule is squashed under a second predetermined pressure at a second predetermined temperature, discharge of the second type of first-single-color dye from the squashed microcapsule occurs.

According to the second aspect of the present invention, to form an image on the image-forming substrate featuring the first and second types of microcapsules, there is provided an image-forming apparatus which comprises a first pressure applicator that exerts the first predetermined pressure on the image-forming substrate, a second pressure applicator that exerts the second predetermined pressure on the image-forming substrate, a first thermal heater that selectively heats a localized area, on which the first predetermined pressure is exerted by the first pressure applicator, to the first predetermined temperature in accordance with first-single-color image-pixel information carrying gradation information, and a second thermal heater that selectively heats a localized area, on which the second predetermined pressure is exerted by the second pressure applicator, to the second predetermined temperature in accordance with the first-single-color image-pixel information carrying the gradation information.

In the second aspect of the present invention, the layer of microcapsules also may comprise a third type of microcapsule filled with a first type of second-single-color dye, and a fourth type of microcapsule filled with a second type of second-single-color dye. The third type of microcapsule exhibits a third temperature/pressure characteristic such that, when the third type of microcapsule is squashed under a third predetermined pressure at a third predetermined temperature, discharge of the first type of second-single-color dye from the squashed microcapsule occurs. The fourth type of microcapsule exhibits a fourth temperature/pressure characteristic such that, when the fourth type of microcapsule is squashed under a fourth predetermined pressure at a fourth predetermined temperature, discharge of the second type of second-single-color dye from the squashed microcapsule occurs.

According to the second aspect of the present invention, to form an image on the image-forming substrate featuring the first, second, third and fourth types of microcapsules, there is provided an image-forming apparatus which comprises a first pressure applicator that exerts the first predetermined pressure on the image-forming substrate, a second pressure applicator that exerts the second predetermined pressure on the image-forming substrate, a third pressure applicator that exerts the third predetermined pressure on the image-forming substrate, a fourth pressure applicator that exerts the fourth predetermined pressure on the image-forming substrate, a first thermal heater that selectively heats a localized area, on which the first predetermined pressure is exerted by the first pressure applicator, to the first predetermined temperature in accordance with first-single-color image-pixel information carrying gradation information, a second thermal heater that selectively heats a localized area, on which the second predetermined pressure is exerted by the second pressure applicator, to the second predetermined temperature in accordance with the first-single-color image-pixel information carrying the gradation information, a third thermal heater that selectively heats a localized area, on which the third predetermined pressure is exerted by the third pressure applicator, to the third predetermined temperature in accordance with second-single-color image-pixel information carrying gradation information, and a fourth thermal heater that selectively heats a localized area, on which the fourth predetermined pressure is exerted by the fourth pressure applicator, to the fourth predetermined temperature in accordance with the second-single-color image-pixel information carrying the gradation information.

In the second aspect of the present invention, the layer of microcapsules may further comprise a fifth type of microcapsule filled with a first type of third-single-color dye, and a sixth type of microcapsule filled with a second type of third-single-color dye. The fifth type of microcapsule exhibits a fifth temperature/pressure characteristic such that, when the fifth type of microcapsule is squashed under a fifth predetermined pressure at a fifth predetermined temperature, discharge of the first type of third-single-color dye from the squashed microcapsule occurs. The sixth type of microcapsule exhibits a sixth temperature/pressure characteristic such that, when the sixth type of microcapsule is squashed under a sixth predetermined pressure at a sixth predetermined temperature, discharge of the second type of third-single-color dye from the squashed microcapsule occurs.

According to the second aspect of the present invention, to form an image on the image-forming substrate featuring the first, second, third, fourth, fifth and sixth types of microcapsules, there is provided an image-forming apparatus which comprises a first pressure applicator that exerts the first predetermined pressure on the image-forming substrate, a second pressure applicator that exerts the second predetermined pressure on the image-forming substrate, a third pressure applicator that exerts the third predetermined pressure on the image-forming substrate, a fourth pressure applicator that exerts the fourth predetermined pressure on the image-forming substrate, a fifth pressure applicator that exerts the fifth predetermined pressure on the image-forming substrate, a sixth pressure applicator that exerts the sixth predetermined pressure on the image-forming substrate, a first thermal heater that selectively heats a localized area, on which the first predetermined pressure is exerted by the first pressure applicator, to the first predetermined temperature in accordance with first-single-color image-pixel information carrying gradation information, a second thermal heater that selectively heats a localized area, on which the second predetermined pressure is exerted by the second pressure applicator, to the second predetermined temperature in accordance with the first-single-color image-pixel information carrying the gradation information, a third thermal heater that selectively heats a localized area, on which the third predetermined pressure is exerted by the third pressure applicator, to the third predetermined temperature in accordance with second-single-color image-pixel information carrying gradation information, a fourth thermal heater that selectively heats a localized area, on which the fourth predetermined pressure is exerted by the fourth pressure applicator, to the fourth predetermined temperature in accordance with the second-single-color image-pixel information carrying the gradation information, a fifth thermal heater that selectively heats a localized area, on which the fifth predetermined pressure is exerted by the fifth pressure applicator, to the fifth predetermined temperature in accordance with third-single-color image-pixel information carrying gradation information, and a sixth thermal heater that selectively heats a localized area, on which the sixth predetermined pressure is exerted by the sixth pressure applicator, to the sixth predetermined temperature in accordance with the third-single-color image-pixel information carrying the gradation information.

Similar to the first aspect of the present invention, if necessary, the first-single-color dye, the second-single-color dye and the third-single-color dye comprise a same single-color dye exhibiting differing densities. Preferably, the first-single-color dye, the second-single-color dye and the third-single-color dye comprises three-primary color dyes. In this case, the image-forming substrate may further comprise an additional layer of microcapsules filled with black dye coated over the layer of microcapsules, and the microcapsules, included in the additional layer of microcapsules, are formed of resin such that they are at least thermally plasticized at a greater temperature than the sixth predetermined temperature and under a lower pressure than the sixth predetermined pressure.

BRIEF DESCRIPTION OF THE DRAWINGS

These object and other objects of the present invention will be better understood from the following description, with reference to the accompanying drawings in which.

DESCRIPTION OF THE PREFERRED EMBODIMENTS

Figure 1:
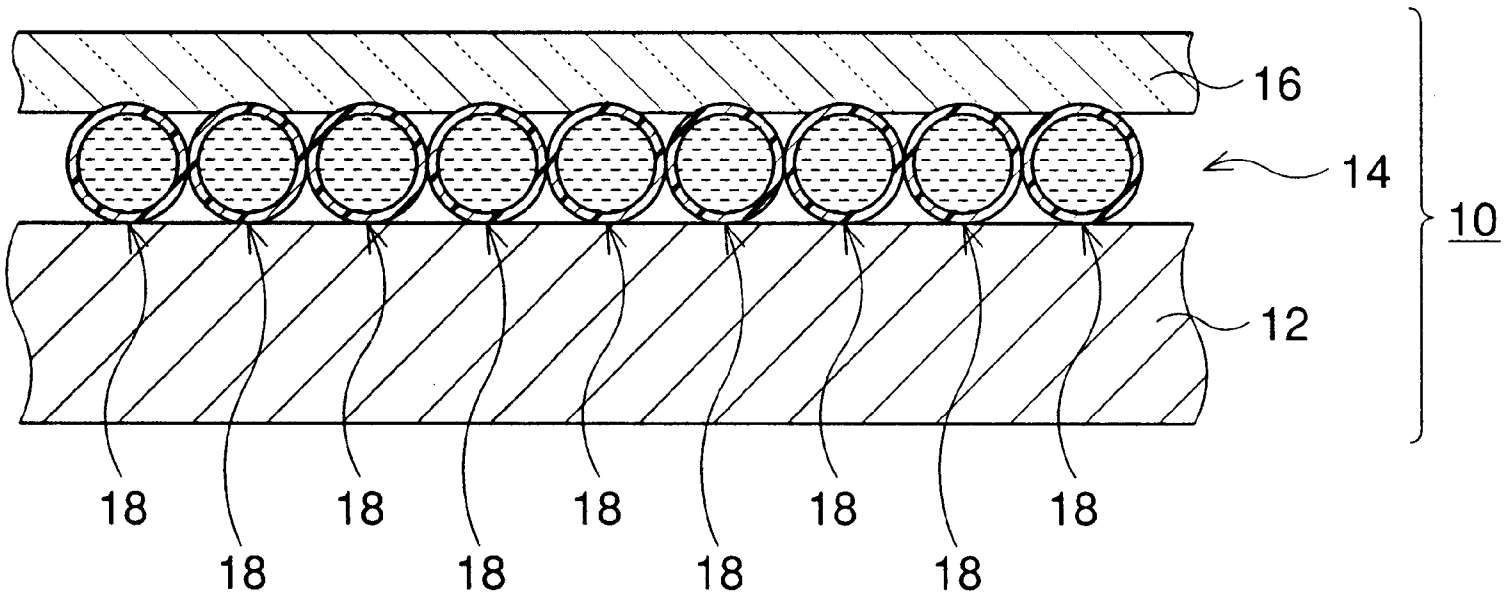
FIG. 1 is a schematic conceptual cross-sectional view showing a first embodiment of an image-forming substrate, according to the present invention, coated with a layer of microcapsules comprising six types of microcapsules filled with dyes exhibiting differing densities.

FIG. 1 shows a first embodiment of an image-forming substrate, generally indicated by reference 10, which is constituted in accordance with the present invention. The image-forming substrate 10 is produced in a form of paper sheet. In particular, the image-forming substrate or sheet 10 comprises a sheet of paper 12, a layer of microcapsules 14 coated over a surface of the paper sheet 12, and a sheet of protective transparent film 16 covering the microcapsule layer 14. The microcapsule layer 14 is formed of a plurality of microcapsules 18 comprising six types of microcapsules uniformly distributed over the surface of the paper sheet 12.

Figure 2:
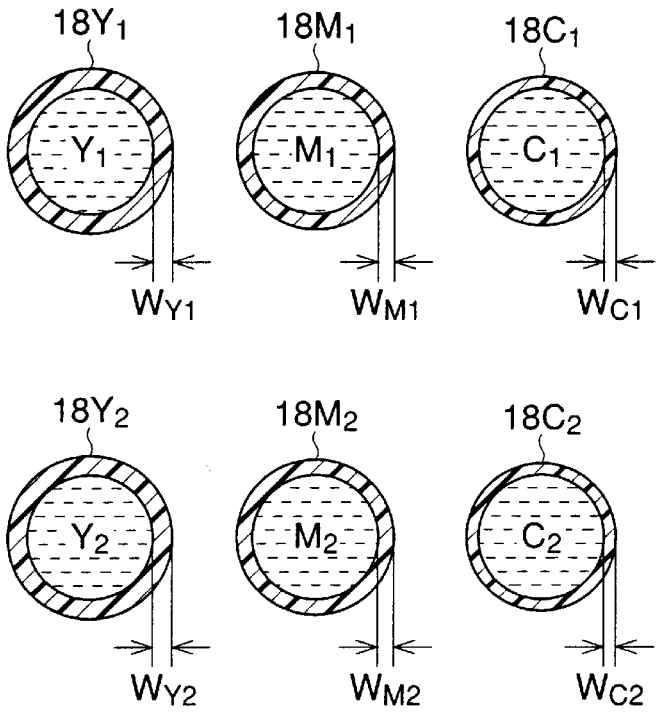
FIG. 2 is a schematic cross-sectional view showing different shell wall thicknesses of the six-types of microcapsules included in the layer of microcapsules shown in FIG. 1.

FIG. 2 representatively shows the six types of microcapsules, indicated by references 18$Y_1$, 18$Y_2$, 18$M_1$, 18$M_2$, 18$C_1$ and 18$C_2$, respectively. A first type of microcapsules 18$Y_1$ is filled with a first type of yellow liquid dye $Y_1$; a second type of microcapsules 18$Y_2$ is filled with a second type of yellow liquid dye $Y_2$; a third type of microcapsules 18$M_1$ is filled with a first type of magenta liquid dye $M_1$; a fourth type of microcapsules 18$M_2$ is filled with a second type of magenta liquid dye $M_2$; a fifth type of microcapsules 18$C_1$ is filled with a first type of cyan liquid dye $C_1$; and a sixth type of microcapsules 18$C_2$ is filled with a second type of cyan liquid dye $C_2$. The first and second types of yellow liquid dyes $Y_1$ and $Y_2$ may exhibit the same density or may exhibit different densities; the first and second types of magenta liquid dyes $M_1$ and $M_2$ may exhibit the same density or may exhibit different densities; and the first and second types of cyan liquid dyes $C_1$ and $C_2$ may exhibit the same density or may exhibit different densities.

In each type of microcapsule (18$Y_1$, 18$Y_2$, 18$M_1$, 18$M_2$, 18$C_1$, 18$C_2$), a shell wall of a microcapsule is formed of a synthetic resin material, usually colored white, which is the same color as the paper sheet 14. Accordingly, if the paper sheet 14 is colored with a single color pigment, the resin material of the microcapsules 18$Y_1$, 18$Y_2$, 18$M_1$, 18$M_2$, 18$C_1$ and 18$C_2$ may be colored by the same single color pigment.

In order to produce each of the types of microcapsules 18$Y_1$, 18$Y_2$, 18$M_1$, 18$M_2$, 18$C_1$ and 18$C_2$, a polymerization method, such as interfacial polymerization, in-situ polymerization or the like, may be utilized. In either case, the microcapsules 18$Y_1$, 18$Y_2$, 18$M_1$, 18$M_2$, 18$C_1$ and 18$C_2$ may have an average diameter of several microns, for example, 5 $\mu$m to 10 $\mu$m.

For the uniform formation of the microcapsule layer 14, for example, the same amounts of microcapsules 18$Y_1$, 18$Y_2$, 18$M_1$, 18$M_2$, 18$C_1$ and 18$C_2$ are homogeneously mixed with a suitable binder solution to form a suspension, and the paper sheet 12 is coated with the binder solution, containing the suspension of microcapsules 18$Y_1$, 18$Y_2$, 18$M_1$, 18$M_2$, 18$C_1$ and 18$C_2$, by using an atomizer. In FIG. 1, for the convenience of illustration, although the microcapsule layer 14 is shown as having a thickness corresponding to the diameter of the microcapsules 18$Y_1$, 18$Y_2$, 18$M_1$, 18$M_2$, 18$C_1$ and 18$C_2$, in reality, the six types of microcapsules 18$Y_1$, 18$Y_2$, 18$M_1$, 18$M_2$, 18$C_1$ and 18$C_2$ overlay each other, and thus the microcapsule layer 14 has a larger thickness than the diameter of a single microcapsule 18$Y_1$, 18$Y_2$, 18$M_1$, 18$M_2$, 18$C_1$ or 18$C_2$.

In the image-forming substrate or sheet 10 shown in FIG. 1, for the resin material of each type of microcapsule (18$Y_1$, 18$Y_2$, 18$M_1$, 18$M_2$, 18$C_1$, 18$C_2$), a shape memory resin is utilized. For example, the shape memory resin is represented by a polyurethane-based-resin, such as polynorbornene, trans-1,4-polyisoprene polyurethane. As other types of shape memory resin, a polyimide-based resin, a polyamide-based resin, a polyvinyl-chloride-based resin, a polyester-based resin and so on are also known.

Figure 3:
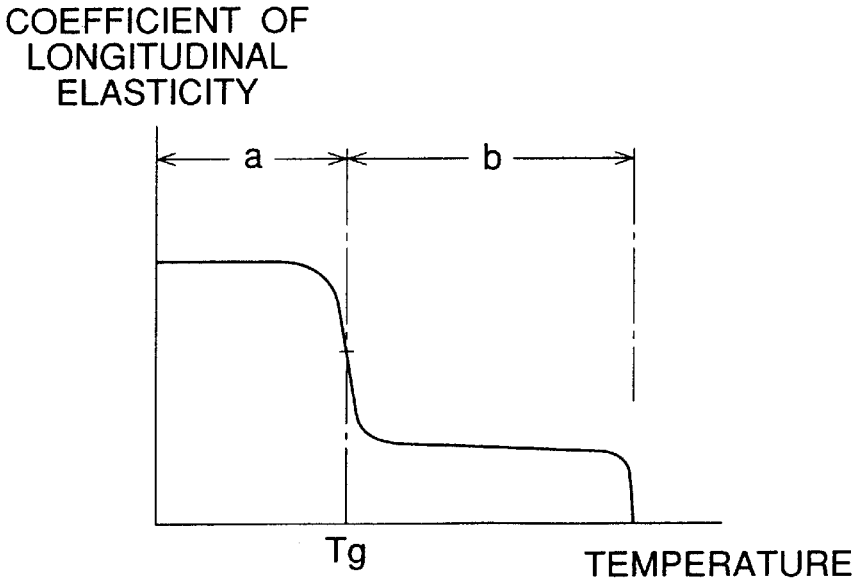
FIG. 3 is a graph showing a characteristic curve of a longitudinal elasticity coefficient of a shape memory resin.

In general, as shown in a graph of FIG. 3, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is below the glass-transition temperature $T_g$, and thus the shape memory resin exhibits a glass-like phase. On the other hand, Brownian movement of the molecular chains becomes increasingly energetic in a high-temperature area "b", which is above the glass-transition temperature $T_g$, and thus the shape memory resin exhibits a rubber elasticity.

The shape memory resin is named due to the following shape memory characteristic: once a mass of the shape memory resin is worked into a finished article in the low-temperature area "a", and is heated to beyond the glass-transition temperature $T_g$, the article becomes freely deformable. After the shaped article is deformed into another shape, and cooled to below the glass-transition temperature $T_g$, the most recent shape of the article is fixed and maintained. Nevertheless, when the deformed article is again heated to above the glass-transition temperature $T_g$, without being subjected to any load or external force, the deformed article returns to the original shape.

In the image-forming substrate or sheet 10, the shape memory characteristic per se is not utilized, but the characteristic abrupt change of the shape memory resin in the longitudinal elasticity coefficient is utilized, such that the six types of microcapsules 18$Y_1$, 18$Y_2$, 18$M_1$, 18$M_2$, 18$C_1$ and 18$C_2$ can be selectively squashed and broken under varying combinations of selected temperatures and pressures.

Figure 4:
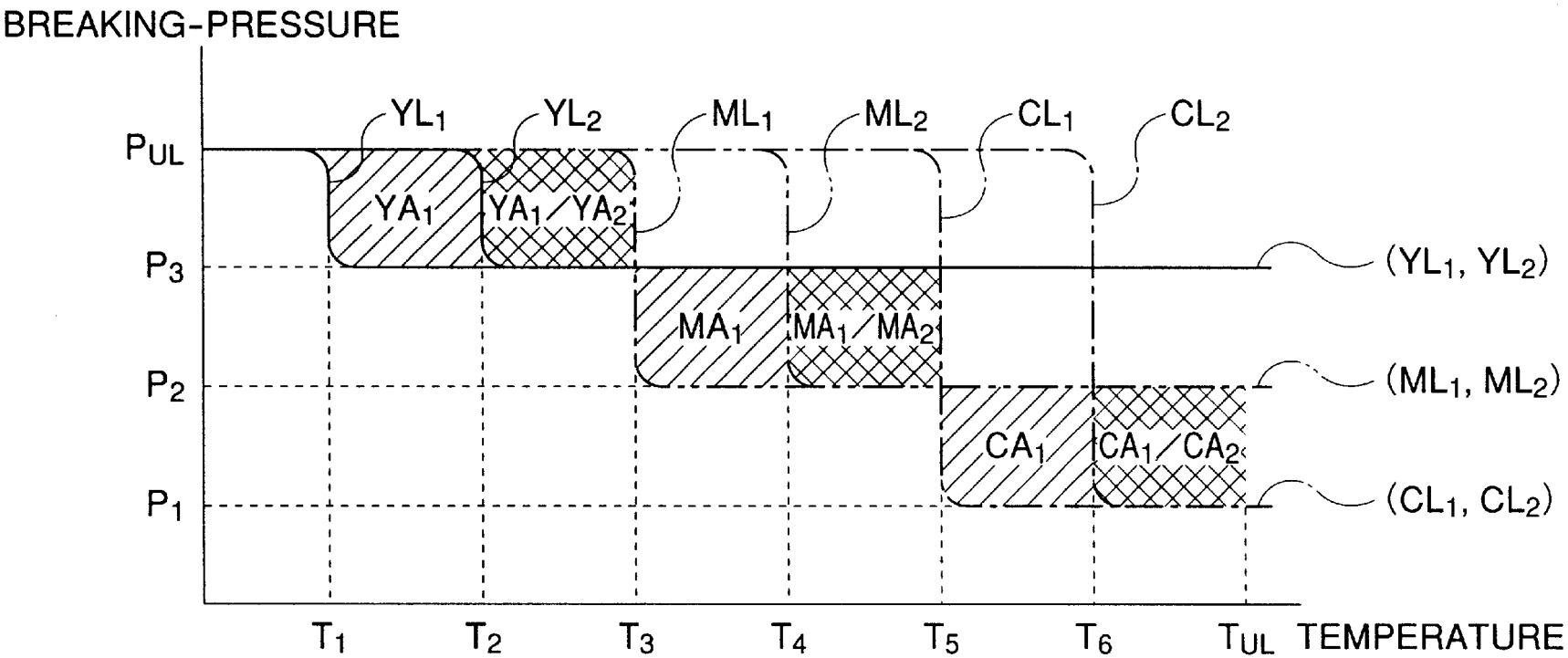
FIG. 4 is a graph showing temperature/pressure compacting characteristics of the six types of microcapsules included in the layer of microcapsules shown in FIG. 1.

In particular, as shown in a graph of FIG. 4, a shape memory resin of the first type of microcapsules 18$Y_1$ is prepared so as to exhibit a characteristic longitudinal elasticity coefficient, indicated by a solid line $YL_1$, having a glass-transition temperature $T_1$; a shape memory resin of the second type of microcapsules 18$Y_2$ is prepared so as to exhibit a characteristic longitudinal elasticity coefficient, indicated by a solid line $YL_2$, having a glass-transition temperature $T_2$; a shape memory resin of the third type of microcapsules 18$M_1$ is prepared so as to exhibit a characteristic longitudinal elasticity coefficient, indicated by a double-chained line $ML_1$, having a glass-transition temperature $T_3$; a shape memory resin of the fourth type of microcapsules 18$M_2$ is prepared so as to exhibit a characteristic longitudinal elasticity coefficient, indicated by a double-chained line $ML_2$, having a gall-transition temperature $T_4$; a shape memory resin of the fifth type of microcapsules 18$C_1$ is prepared so as to exhibit a characteristic longitudinal elasticity coefficient, indicated by a single-chained line $CL_1$, having a glass-transition temperature $T_5$; and a shape memory resin of the sixth type of microcapsules 18$C_2$ is prepared so as to exhibit a characteristic longitudinal elasticity coefficient, indicated by a single-chained line $CL_2$, having a glass-transition temperature $T_6$.

Note, by suitably varying compositions of the shape memory resin and/or by selecting a suitable one from among various types of shape memory resin, it is possible to obtain the respective shape memory resins, with the glass-transition temperatures $T_1$, $T_2$, $T_3$, $T_4$, $T_5$ and $T_6$. By way of non-limiting example, the glass-transition temperature $T_1$ is preferably selected from a temperature range of 65°–70° C., and the remaining temperatures $T_2$–$T_6$ are set at increments of 20° C. higher. Thus, if $T_1$ is at 68° C., then $T_2$, $T_3$, $T_4$, $T_5$ and $T_6$ are set to 88° C., 108° C., 128° C., 148° C., and 168° C., respectively.

As shown in FIG. 2, the microcapsule walls of the six types of microcapsules 18$Y_1$, 18$Y_2$, 18$M_1$, 18$M_2$, 18$C_1$ and 18$C_2$, respectively, have differing thicknesses $W_{Y1}$, $W_{Y2}$, $W_{M1}$, $W_{M2}$, $W_{C1}$ and $W_{C2}$. Namely, the thicknesses $W_{Y1}$ and $W_{Y2}$ of the first and second types of microcapsules 18$Y_1$ and 18$Y_2$ are larger than the thicknesses $W_{M1}$ and $W_{M2}$ of the third and fourth types of microcapsules 18$M_1$ and 18$M_2$, and the thicknesses $W_{M1}$ and $W_{M2}$ of the third and fourth types of microcapsules 18$M_1$ and 18$M_2$ are larger than the thicknesses $W_{C1}$ and $W_{C2}$ of the fifth and sixth types of microcapsules 18$C_1$ and 18$C_2$.

The thickness $W_{Y1}$ of the first type of microcapsules 18$Y_1$ is selected such that each microcapsule 18$Y_1$ is compacted and broken under a breaking pressure that lies between a critical breaking pressure $P_3$ and an upper limit pressure $P_{UL}$ (FIG. 4), when each microcapsule 18$Y_1$ is heated to a temperature between the glass-transition temperatures $T_1$ and $T_3$. The thickness $W_{Y2}$ of the second type of microcapsules 18$Y_2$ is selected such that each microcapsule 18$Y_2$ is compacted and broken under a breaking pressure that lies between the critical breaking pressure $P_3$ and the upper limit pressure $P_{UL}$ (FIG. 4), when each microcapsule 18$Y_2$ is heated to a temperature between the glass-transition temperatures $T_2$ and $T_3$.

The thickness $W_{M1}$ of the third type of microcapsules 18$M_1$ is selected such that each microcapsule 18$M_1$ is compacted and broken under a breaking pressure that lies between critical breaking pressures $P_2$ and $P_3$ (FIG. 4), when each microcapsule 18$M_1$ is heated to a temperature between the glass-transition temperatures $T_3$ and $T_5$. The thickness $W_{M2}$ of the fourth type of microcapsules 18$M_2$ is selected such that each microcapsule 18$M_2$ is compacted and broken under a breaking pressure that lies between the critical breaking pressures $P_2$ and $P_3$ (FIG. 4), when each microcapsule 18$M_2$ is heated to a temperature between the glass-transition temperatures $T_4$ and $T_5$.

The thickness $W_{C1}$ of the fifth type of microcapsules 18$C_1$ is selected such that each microcapsule 18$C_1$ is compacted and broken under a breaking pressure that lies between critical breaking pressures $P_1$ and $P_2$ (FIG. 4), when each microcapsule 18$C_1$ is heated to a temperature between the glass-transition temperature $T_5$ and an upper limit temperature $T_{UL}$ (FIG. 4). The thickness $W_{C2}$ of the sixth type of microcapsules 18$C_2$ is selected such that each microcapsule 18$C_2$ is compacted and broken under a breaking pressure that lies between the critical breaking pressures $P_1$ and $P_2$ (FIG. 4), when each microcapsule 18$C_2$ is heated to a temperature between the glass-transition temperature $T_6$ and the upper limit temperature $T_{UL}$.

It is noted that when the glass transition temperatures $T_1$, $T_2$, $T_3$, $T_4$, $T_5$ and $T_6$ are set as mentioned above, the upper limit temperature $T_{UL}$ is preferably selected from 185° C.–190° C., i.e., 20° C. above the selected $T_6$ temperature.

By way of non-limiting example, the pressures $P_1$, $P_2$, $P_3$, and $P_{UL}$, are preferably set to 0.02, 0.2, 2.0, and 20 MPa, respectively.

As is apparent from the foregoing, by suitably selecting a heating temperature and a breaking pressure, which should be exerted on the image-forming sheet 10, it is possible to selectively squash and break the first, second, third, fourth, fifth and sixth types of microcapsules 18$Y_1$, 18$Y_2$, 18$M_1$, 18$M_2$, 18$C_1$ and 18$C_2$.

For example, if the selected heating temperature and breaking pressure fall within a hatched yellow area $YA_1$ (FIG. 4), defined by a temperature range between the glass-transition temperatures $T_1$ and $T_2$ and by a pressure range between the critical breaking pressure $P_3$ and the upper limit pressure $P_{UL}$, only the first type of microcapsules 18$Y_1$ is squashed and broken. If the selected heating temperature and breaking pressure fall within a hatched yellow area $YA_1/YA_2$, defined by a temperature range between the glass-transition temperatures $T_2$ and $T_3$ and by a pressure range between the critical breaking pressure $P_3$ and the upper limit pressure $P_{UL}$, both the first and second types of microcapsules 18$Y_1$ and 18$Y_2$ are squashed and broken.

Also, if the selected heating temperature and breaking pressure fall within a hatched magenta area $MA_1$ (FIG. 4), defined by a temperature range between the glass-transition temperatures $T_3$ and $T_4$ and by a pressure range between the critical breaking pressures $P_2$ and $P_3$, only the third type of microcapsules 18$M_1$ is squashed and broken. If the selected heating temperature and breaking pressure fall within a hatched magenta area $MA_1/MA_2$, defined by a temperature range between the glass-transition temperatures $T_4$ and $T_5$ and by a pressure range between the critical breaking pressures $P_2$ and $P_3$, both the third and fourth types of microcapsules 18$M_1$ and 18$M_2$ are squashed and broken.

Further, if the selected heating temperature and breaking pressure fall within a hatched cyan area $CA_1$ (FIG. 4), defined by a temperature range between the glass-transition temperatures $T_5$ and $T_6$ and by a pressure range between the critical breaking pressures $P_1$ and $P_2$, only the fifth type of microcapsules 18$C_1$ is squashed and broken. If the selected heating temperature and breaking pressure fall within a hatched cyan area $CA_1/CA_2$, defined by a temperature range between the glass-transition temperature $T_6$ and the upper limit temperature $T_{UL}$ and by a pressure range between the critical breaking pressures $P_1$ and $P_2$, both the fifth and sixth types of microcapsules 18$C_1$ and 18$C_2$ are squashed and broken.

Figure 5:
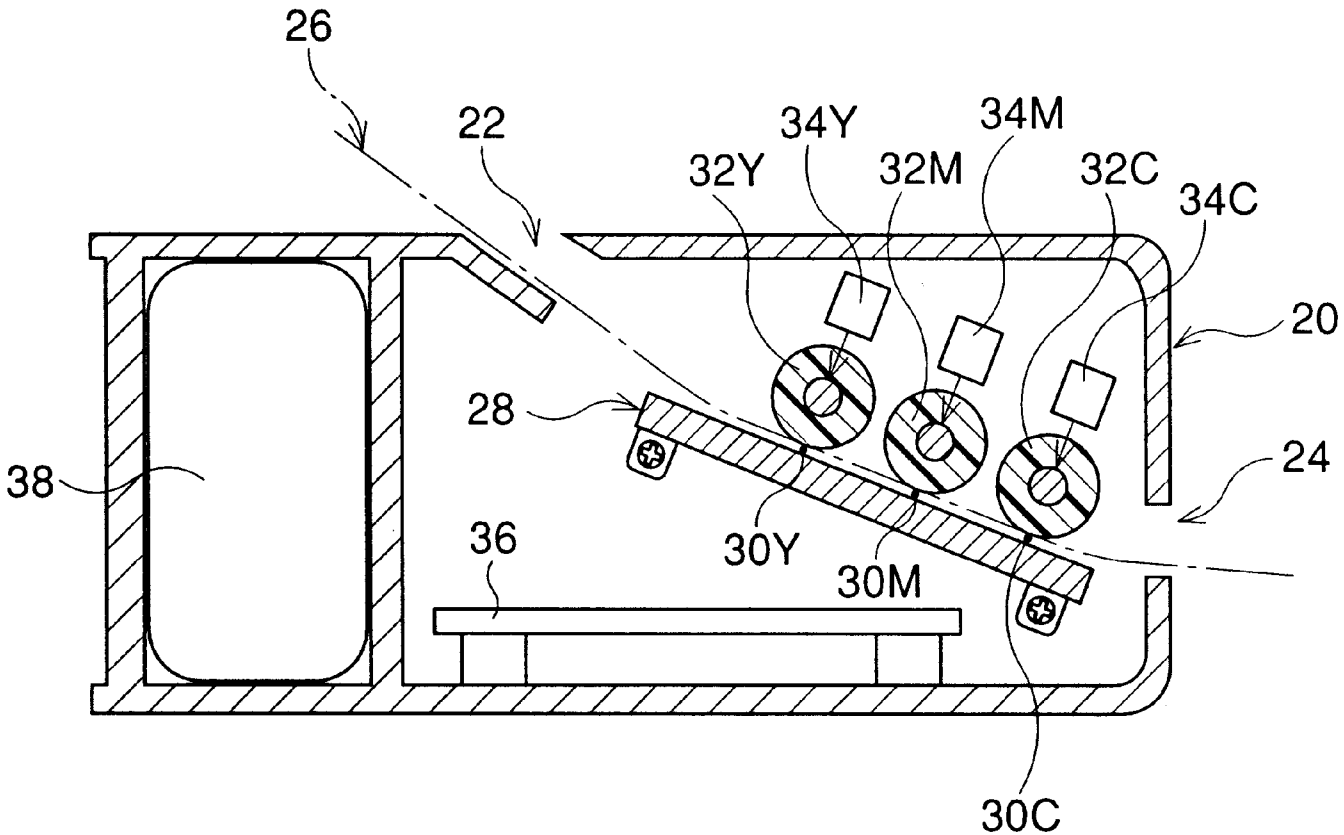
FIG. 5 a schematic cross-sectional view of a color printer for forming a color image on the image-forming substrate shown in FIG. 1.

FIG. 5 schematically shows a thermal color printer, which is constituted as a line printer so as to form a color image on the image-forming sheet 10, which features by the first, second, third, fourth, fifth and sixth types of microcapsules 18$Y_1$, 18$Y_2$, 18$M_1$, 18$M_2$, 18$C_1$ and 18$C_2$.

The color printer comprises a generally-rectangular parallelopiped housing 20 having an entrance opening 22 and an exit opening 24 formed in a top wall and a side wall of the housing 20, respectively. The image-forming sheet 10 (not shown in FIG. 5) is introduced into the housing 20 through the entrance opening 22, and is then discharged from the exit opening 24 after the formation of a color image on the image-forming sheet 10. Note, in FIG. 5, a path 26 for movement of the image-forming sheet 10 is indicated by a chained line.

A guide plate 28 is provided in the housing 20 so as to define a part of the path 26 for the movement of the image-forming sheet 10, and a first thermal head 30Y, a second thermal head 30M and a third thermal head 30C are securely attached to a surface of the guide plate 28. The thermal heads 30Y, 30M and 30C are essentially identical to each other, and each thermal head (30Y, 30M, 30C) is formed as a line thermal head extending perpendicularly with respect to a direction of movement of the image-forming sheet 10. Each of the thermal heads 30Y, 30M and 30C includes a plurality of heater elements or electric resistance elements, and these electric resistance elements are aligned with each other along a length of the corresponding line thermal head (30Y, 30M, 30C).

The first thermal head 30Y is used to form a yellow-dotted image on the image-forming sheet 10, and each of the electric resistance elements thereof is selectively and electrically energized to produce a yellow-image-pixel dot in accordance with a digital yellow image-pixel signal carrying a 2-bit digital gradation signal. When the digital yellow image-pixel signal has a value "0", the corresponding electric resistance element is not electrically energized. When the digital yellow image-pixel signal has a value "1", the corresponding electric resistance element is electrically energized and heated to either a temperature between the glass-transition temperatures $T_1$ and $T_2$ or a temperature between the glass-transition temperatures $T_2$ and $T_3$, in accordance with the 2-bit digital gradation signal carried by the digital yellow image-pixel signal.

The second thermal head 30M is used to form a magenta-dotted image on the image-forming sheet 10, and each of the electric resistance elements thereof is selectively and electrically energized to produce a magenta-image-pixel dot in accordance with a digital magenta image-pixel signal carrying a 2-bit digital gradation signal. When the digital magenta image-pixel signal has a value "0", the corresponding electric resistance element is not electrically energized. When the digital magenta image-pixel signal has a value "1", the corresponding electric resistance element is electrically energized and heated to either a temperature between the glass-transition temperatures $T_3$ and $T_4$ or a temperature between the glass-transition temperatures $T_4$ and $T_5$, in accordance with the 2-bit digital gradation signal carried by the digital magenta-pixel signal.

The third thermal head 30C is used to form a cyan-dotted image on the image-forming sheet 10, and each of the electric resistance elements thereof is selectively and electrically energized to produce a cyan-image-pixel dot in accordance with a digital cyan image-pixel signal carrying a 2-bit digital gradation signal. When the digital cyan image-pixel signal has a value "0", the corresponding electric resistance element is not electrically energized. When the digital cyan image-pixel signal has a value "1", the corresponding electric resistance element is electrically energized and heated to either a temperature between the glass-transition temperatures $T_5$ and $T_6$ or a temperature between the glass-transition temperatures $T_6$ and the upper limit temperature $T_{UL}$, in accordance with the 2-bit digital gradation signal carried by the digital cyan image-pixel signal.

Note, the line thermal heads 30Y, 30M and 30C are arranged in sequence so that the respective heating temperatures increase in the movement direction of the image-forming sheet 10.

The color printer further comprises a first roller platen 32Y, a second roller platen 32M and a third roller platen 32C associated with the first, second and third thermal heads 30Y, 30M and 30C, respectively, and each of the roller platens 32Y, 32M and 32C may be formed of a suitable hard rubber material. The first roller platen 32Y is provided with a first spring-biasing unit 34Y so as to be elastically pressed against the first thermal head 30Y at a pressure between the critical compacting-pressure $P_3$ and the upper limit pressure $P_{UL}$; the second roller platen 32M is provided with a second spring-biasing unit 34M so as to be elastically pressed against the second thermal head 30M at a pressure between the critical compacting-pressures $P_2$ and $P_3$; and the third roller platen 32C is provided with a third spring-biasing unit 34C so as to be elastically pressed against the third thermal head 30C at a pressure between the critical compacting-pressures $P_1$ and $P_2$.

Note, the platens 32Y, 32M and 32C are arranged in sequence so that the respective pressures, exerted by the platens 32Y, 32M and 32C on the line thermal heads 30Y, 30M and 30C, decrease in the movement direction of the image-forming sheet 10.

In FIG. 5, reference 36 indicates a control circuit board for controlling a printing operation of the color printer, and reference 38 indicates a main electrical power source for electrically energizing the control circuit board 36.

Figure 6:
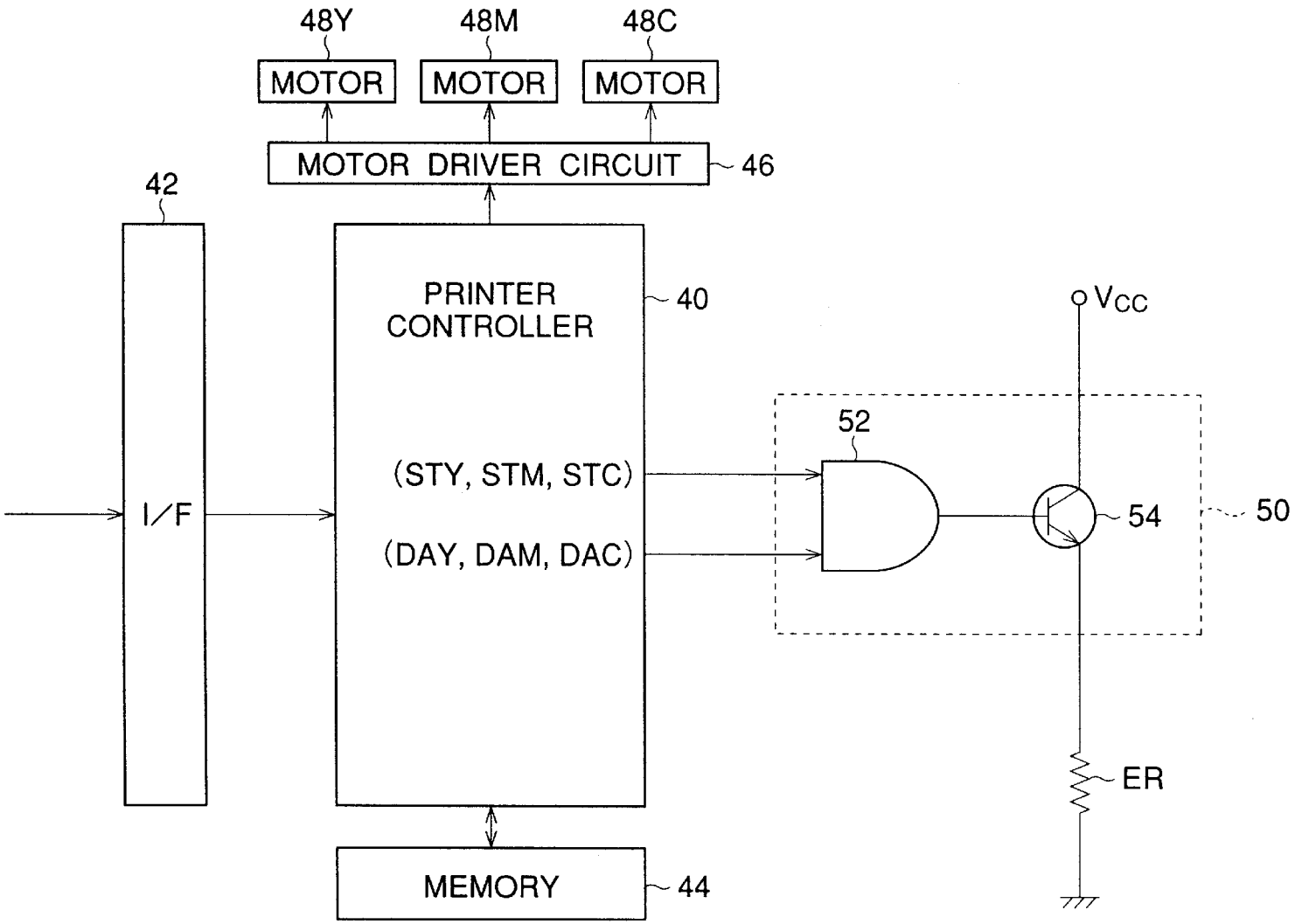
FIG. 6 is a partial schematic block diagram of a control circuit for the color printer of FIG. 5, which shows representatively a driver circuit used in three line thermal heads of the color printer.

FIG. 6 shows a part of a schematic block diagram of the control circuit board 36. As shown in this drawing, the control circuit board 36 comprises a printer controller 40 including a microcomputer. The printer controller 40 receives a series of digital color image-pixel signals from a personal computer or a word processor (not shown) through an interface circuit (I/F) 42, with each of the digital color image-pixel signals carrying a digital 2-bit gradation-signal. The received digital color image-pixel signals (i.e., digital cyan image-pixel signals carrying 2-bit digital gradation signals, digital magenta image-pixel signals carrying 2-bit digital gradation signals, and digital yellow image-pixel signals carrying 2-bit digital gradation signals) are once stored in a memory 44.

Also, the control circuit board 36 is provided with a motor driver circuit 46 for driving three electric motors 48Y, 48M and 48C, which are used to rotationally drive the roller platens 32Y, 32M and 32C, respectively. In this embodiment of the color printer, each of the motors 48Y, 48M and 48C is a stepping motor, which is driven in accordance with a series of drive pulses outputted from the motor driver circuit 46, the outputting of drive pulses from the motor driver circuit 46 to the motors 48Y, 48M and 48C being controlled by the printer controller 40.

During a printing operation, the respective roller platens 32Y, 32M and 32C are rotated in a counterclockwise direction (FIG. 5) by the motors 48Y, 48M and 48C, with a same peripheral speed. Accordingly, the image-forming sheet 10, introduced through the entrance opening 22, moves toward the exit opening 24 along the path 26.

Thus, the image-forming sheet 10 is subjected to pressure ranging between the critical compacting-pressure $P_3$ and the upper limit pressure $P_{UL}$ when passing between the first thermal head 30Y and the first roller platen 32Y; to pressure ranging between the critical compacting-pressures $P_2$ and $P_3$ when passing between the second thermal head 30M and the second roller platen 32M; and to pressure ranging between the critical compacting-pressures $P_1$ and $P_2$ when passing between the third thermal head 30C and the third roller platen 32C.

Note, in this embodiment of the color printer, the introduction of the image-forming sheet 10 into the entrance opening 22 of the printer is carried out such that the transparent protective film sheet 16 of the image-forming sheet 10 comes into contact with the thermal heads 30Y, 30M and 30C.

In FIG. 6, only one of the electric resistance elements, included in the line thermal heads 30Y, 30M and 30C, is representatively illustrated, and is indicated by reference ER. The electric resistance element ER is selectively and electrically energized by a driver circuit 50 under control of the printer controller 40. The driver circuit 50 includes an AND-gate circuit 52 and a transistor 54. As shown in FIG. 6, a set of a strobe signal (STC, STM or STY) and a control signal (DAC, DAM or DAY) is inputted from the printer controller 40 to two input terminals of the AND-gate circuit 52. A base of the transistor 54 is connected to an output terminal of the AND-gate circuit 52; a collector of the transistor 54 is connected to an electric power source ($V_{cc}$); and an emitter of the transistor 54 is connected to the electric resistance element ER.

When the electric resistance element ER, as shown in FIG. 6, is one included in the first thermal head 30Y, a set of a strobe signal "STY" and a control signal "DAY" is outputted from the printer controller 40, and is then inputted to the input terminals of the AND-gate circuit 52, during a printing operation. As shown in a timing chart of FIG. 7, the strobe signal "STY" has a pulse width "PWY", and the control signal "DAY" is varied in accordance with binary values of a digital yellow image-pixel signal "Y" and a 2-bit digital gradation signal "GSY" carried thereby, as shown in a table of FIG. 8.

Figures 7, 8:
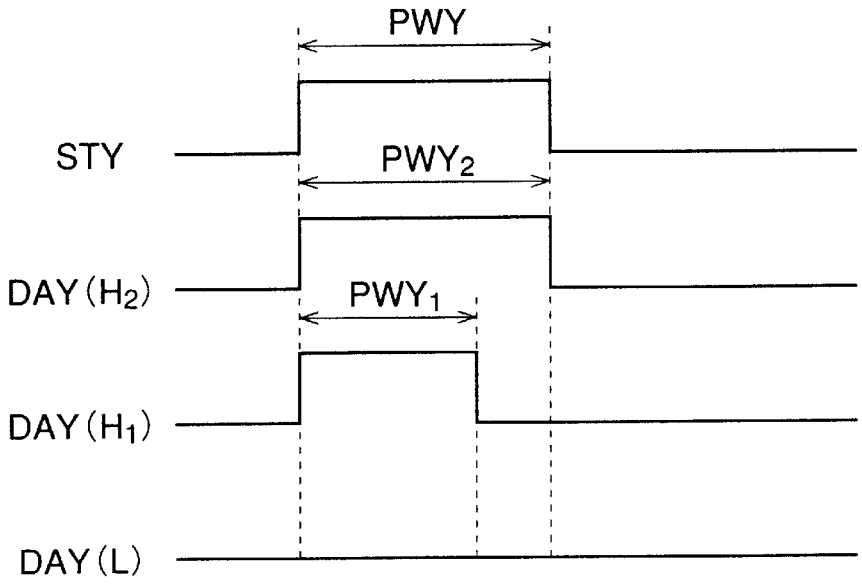
FIG. 7 is a timing chart showing a strobe signal and a control signal for electronically actuating the thermal head driver circuit for producing a yellow dot on the image-forming substrate of FIG. 1.
FIG. 8 is a table showing a relationship between a digital yellow image-pixel signal carrying a 2-bit gradation-signal for producing the control signal and a variation of the control signal caused by a combination of the digital yellow image-pixel signal and the 2-bit gradation-signal.

Namely, when the digital yellow image-pixel signal "Y" has a value "0", and when the 2-bit digital gradation signal "GSY" has a value [00], the control signal "DAY" is maintained at a low-level under control of the printer controller 40 (FIGS. 7 and 8). When the digital yellow image-pixel signal has a value "1", the control signal "DAY" is outputted as a high-level pulse from the printer controller 40, and a pulse width of the high-level pulse is varied in accordance with a value of the 2-bit digital gradation signal "GSY".

Figure 9:
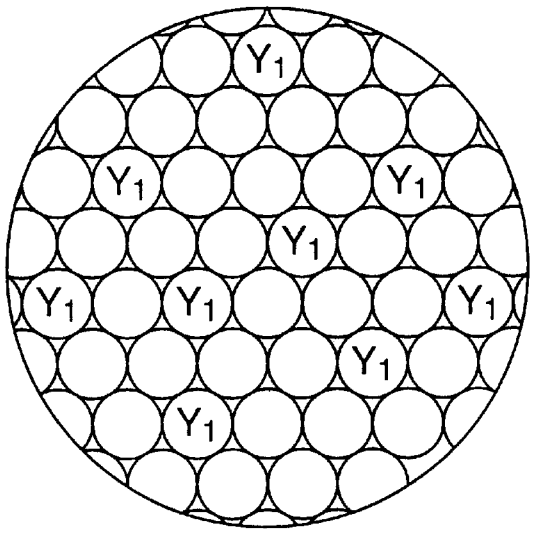
FIG. 9 is a conceptual view showing an example of variation in density (gradation) of a yellow dot produced on the image-forming substrate of FIG. 1.

In particular, when the 2-bit digital gradation signal "GSY" has a value of [01], the high-level pulse of the control signal "DAY" has a pulse width "$PWY_1$" shorter than the pulse width "PWY" of the strobe signal "STY". Thus, the electric resistance element ER is electrically energized during a period corresponding to the pulse width "$PWY_1$" of the high-level pulse of the control signal "DAY", whereby the electric resistance element ER is heated to the temperature between the glass-transition temperatures $T_1$ and $T_2$. Accordingly, in a dot area, defined by the electric resistance element ER, on the image-forming sheet 10, only the microcapsules 18$Y_1$ are compacted and broken, resulting in seepage of the first type of yellow liquid dye $Y_1$ from the compacted and broken microcapsules 18$Y_1$ in the dot area, as shown in FIG. 9. Namely, a yellow dot, which is colored by only the first type of yellow liquid dye $Y_1$, is produced on the image-forming sheet 10.

Figure 10:
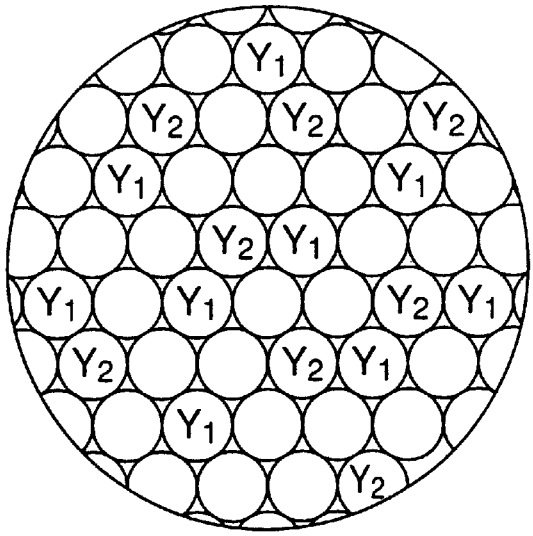
FIG. 10 is a conceptual view showing another example of variation in density (gradation) of a yellow dot produced on the image-forming substrate of FIG. 1.

Also, when the 2-bit digital gradation signal "GSY" has a value of [10], the high-level pulse of the control signal "DAY" has the same pulse width "$PWY_2$" as the pulse width "PWY" of the strobe signal "STY". Thus, the electric resistance element ER is electrically energized during a period corresponding to the pulse width "$PWY_2$" of the high-level pulse of the control signal "DAY", whereby the electric resistance element ER is heated to the temperature between the glass-transition temperatures $T_2$ and $T_3$. Accordingly, in a dot area, defined by the electric resistance element ER, on the image-forming sheet 10, both the microcapsules 18$Y_1$ and the microcapsules 18$Y_2$ are compacted and broken, resulting in seepage of the first and second types of yellow liquid dyes $Y_1$ and $Y_2$ from the compacted and broken microcapsules 18$Y_1$ and 18$Y_2$, as shown in FIG. 10. Namely, a yellow dot, which is colored by both the first and second types of yellow liquid dyes $Y_1$ and $Y_2$, is produced on the image-forming sheet 10.

Of course, a yellow density of the yellow dot, colored by only the first type of yellow dye $Y_1$, is different from that of the yellow dot colored by both the first and second types of yellow liquid dyes $Y_1$ and $Y_2$, thereby obtaining a variation in density (gradation) of the yellow dot.

When the electric resistance element ER, as shown in FIG. 6, is one included in the second thermal head 30M, a set of a strobe signal "STM" and a control signal "DAM" is outputted from the printer controller 40, and is then inputted to the input terminals of the AND-gate circuit 52, during a printing operation. As shown in a timing chart of FIG. 11, the strobe signal "STM" has a pulse width "PWM", longer than the pulse width of the strobe signal "STY" (FIG. 7), and the control signal "DAM" is varied in accordance with binary values of a digital magenta image-pixel signal "M" and a 2-bit digital gradation signal "GSM" carried thereby, as shown in a table of FIG. 12.

Figures 11, 12:
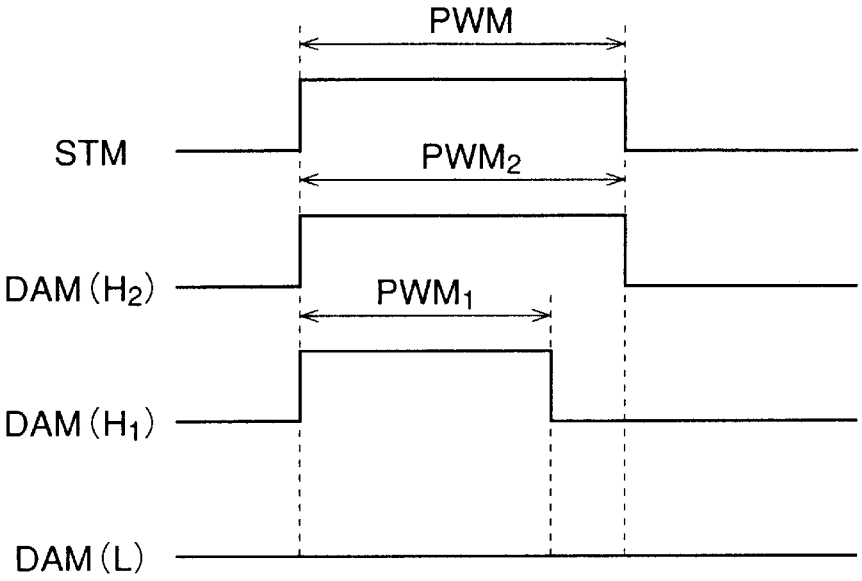
FIG. 11 is a timing chart showing a strobe signal and a control signal for electronically actuating the thermal head driver circuit for producing a magenta dot on the image-forming substrate of FIG. 1.
FIG. 12 is a table showing a relationship between a digital magenta image-pixel signal carrying a 2-bit gradation-signal for producing the control signal and a variation of the control signal caused by a combination of the digital magenta image-pixel signal and the 2-bit gradation-signal.

Namely, when the digital magenta image-pixel signal "M" has a value "0", and when the 2-bit digital gradation signal "GSM" has a value [00], the control signal "DAM" is maintained at a low-level under control of the printer controller 40 (FIGS. 11 and 12). When the digital magenta image-pixel signal has a value "1", the control signal "DAM" is outputted as a high-level pulse from the printer controller 40, and a pulse width of the high-level pulse is varied in accordance with a value of the 2-bit digital gradation signal "GSM".

In particular, when the 2-bit digital gradation signal "GSM" has a value of [01], the high-level pulse of the control signal "DAM" has a pulse width "$PWM_1$" shorter than the pulse width "PWM" of the strobe signal "STM". Thus, the electric resistance element ER is electrically energized during a period corresponding to the pulse width "$PWM_1$" of the high-level pulse of the control signal "DAM", whereby the electric resistance element ER is heated to the temperature between the glass-transition temperatures $T_3$ and $T_4$. Accordingly, in a dot area, defined by the electric resistance element ER, on the image-forming sheet 10, only the microcapsules 18$M_1$ are compacted and broken, resulting in seepage of the first type of magenta liquid dye $M_1$ from the compacted and broken microcapsules 18$M_1$ in the dot area. Namely, a magenta dot, which is colored by only the first type of magenta liquid dye $M_1$, is produced on the image-forming sheet 10.

Also, when the 2-bit digital gradation signal "GSM" has a value of [10], the high-level pulse of the control signal "DAM" has the same pulse width "$PWM_2$"as the pulse width "PWM" of the strobe signal "STM". Thus, the electric resistance element ER is electrically energized during a period corresponding to the pulse width "$PWM_2$" of the high-level pulse of the control signal "DAM", whereby the electric resistance element ER is heated to the temperature between the glass-transition temperatures $T_4$ and $T_5$. Accordingly, in a dot area, defined by the electric resistance element ER, on the image-forming sheet 10, both the microcapsules 18$M_1$ and the microcapsules 18$M_2$ are compacted and broken, resulting in seepage of the first and second types of magenta liquid dyes $M_1$ and $M_2$ from the compacted and broken microcapsules 18$M_1$ and 18$M_2$. Namely, a magenta dot, which is colored by both the first and second types of magenta liquid dyes $M_1$ and $M_2$, is produced on the image-forming sheet 10.

Of course, a magenta density of the magenta dot, colored by only the first type of magenta dye $M_1$, is different from that of the magenta dot colored by both the first and second types of magenta liquid dyes $M_1$ and $M_2$, thereby obtaining a variation in density (gradation) of the magenta dot.

When the electric resistance element ER, as shown in FIG. 6, is one included in the third thermal head 30C, a set of a strobe signal "STC" and a control signal "DAC" is outputted from the printer controller 40, and is then inputted to the input terminals of the AND-gate circuit 52, during a printing operation. As shown in a timing chart of FIG. 13, the strobe signal "STC" has a pulse width "PWC", longer than the pulse width of the strobe signal "STM" (FIG. 11), and the control signal "DAC" is varied in accordance with binary values of a digital cyan image-pixel signal "C" and a 2-bit digital gradation signal "GSC" carried thereby, as shown in a table of FIG. 14.

Figures 13, 14:
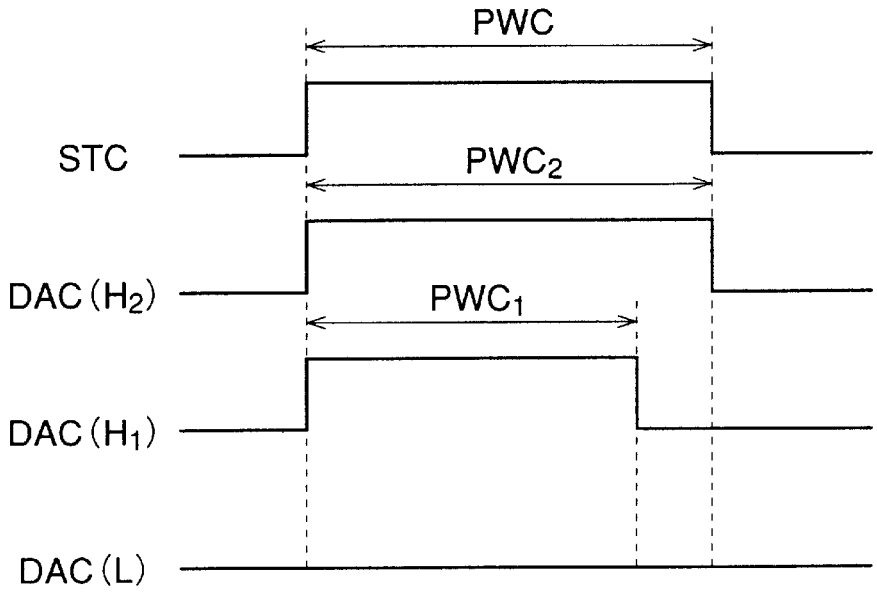
FIG. 13 is a timing chart showing a strobe signal and a control signal for electronically actuating the thermal head driver circuit for producing a cyan dot on the image-forming substrate of FIG. 1.
FIG. 14 is a table showing a relationship between a digital cyan image-pixel signal carrying a 2-bit gradation-signal for producing the control signal and a variation of the control signal caused by a combination of the digital cyan image-pixel signal and the 2-bit gradation-signal.

Namely, when the digital cyan image-pixel signal "C" has a value "0", and when the 2-bit digital gradation signal "GSC" has a value [00], the control signal "DAC" is maintained at a low-level under control of the printer controller 40 (FIGS. 13 and 14). When the digital cyan image-pixel signal has a value "1", the control signal "DAC" is outputted as a high-level pulse from the printer controller 40, and a pulse width of the high-level pulse is varied in accordance with a value of the 2-bit digital gradation signal "GSC".

In particular, when the 2-bit digital gradation signal "GSC" has a value of [01], the high-level pulse of the control signal "DAC" has a pulse width "$PWC_1$" shorter than the pulse width "PWC" of the strobe signal "STC" . Thus, the electric resistance element ER is electrically energized during a period corresponding to the pulse width "$PWC_1$" of the high-level pulse of the control signal "DAC", whereby the electric resistance element ER is heated to the temperature between the glass-transition temperatures $T_5$ and $T_6$. Accordingly, in a dot area, defined by the electric resistance element ER, on the image-forming sheet 10, only the microcapsules 18$C_1$ are compacted and broken, resulting in seepage of the first type of cyan liquid dye $C_1$ from the compacted and broken microcapsules 18$C_1$ in the dot area. Namely, a cyan dot, which is colored by only the first type of cyan liquid dye $C_1$, is produced on the image-forming sheet 10.

Also, when the 2-bit digital gradation signal "GSC" has a value of [10], the high-level pulse of the control signal "DAC" has the same pulse width "$PWC_2$" as the pulse width "PWC" of the strobe signal "STC". Thus, the electric resistance element ER is electrically energized during a period corresponding to the pulse width "$PWC_2$" of the high-level pulse of the control signal "DAC", whereby the electric resistance element ER is heated to the temperature between the glass-transition temperatures $T_6$ and the upper limit temperature $T_{UL}$. Accordingly, in a dot area, defined by the electric resistance element ER, on the image-forming sheet 10, both the microcapsules 18$C_1$ and the microcapsules 18$C_2$ are compacted and broken, resulting in seepage of the first and second types of cyan liquid dyes $C_1$ and $C_2$ from the compacted and broken microcapsules 18$C_1$ and 18$C_2$. Namely, a cyan dot, which is colored by both the first and second types of cyan liquid dyes $C_1$ and $C_2$, is produced on the image-forming sheet 10.

Of course, a cyan density of the cyan dot, colored by only the first type of cyan dye $C_1$, is different from that of the cyan dot colored by both the first and second types of cyan liquid dyes $C_1$ and $C_2$, thereby obtaining a variation in density (gradation) of the cyan dot.

Note, the yellow dot, the magenta dot and the cyan dot, produced on the image-forming sheet 10, have a dot size of about 50 $\mu$m to about 100 $\mu$m, and the first, second, third, fourth, fifth and sixth types of microcapsules 18$Y_1$, 18$Y_2$, 18$M_1$, 18$M_2$, 18$C_1$ and 18$C_2$ are uniformly included in a dot area to be produced on the image-forming sheet 10.

Figure 15:
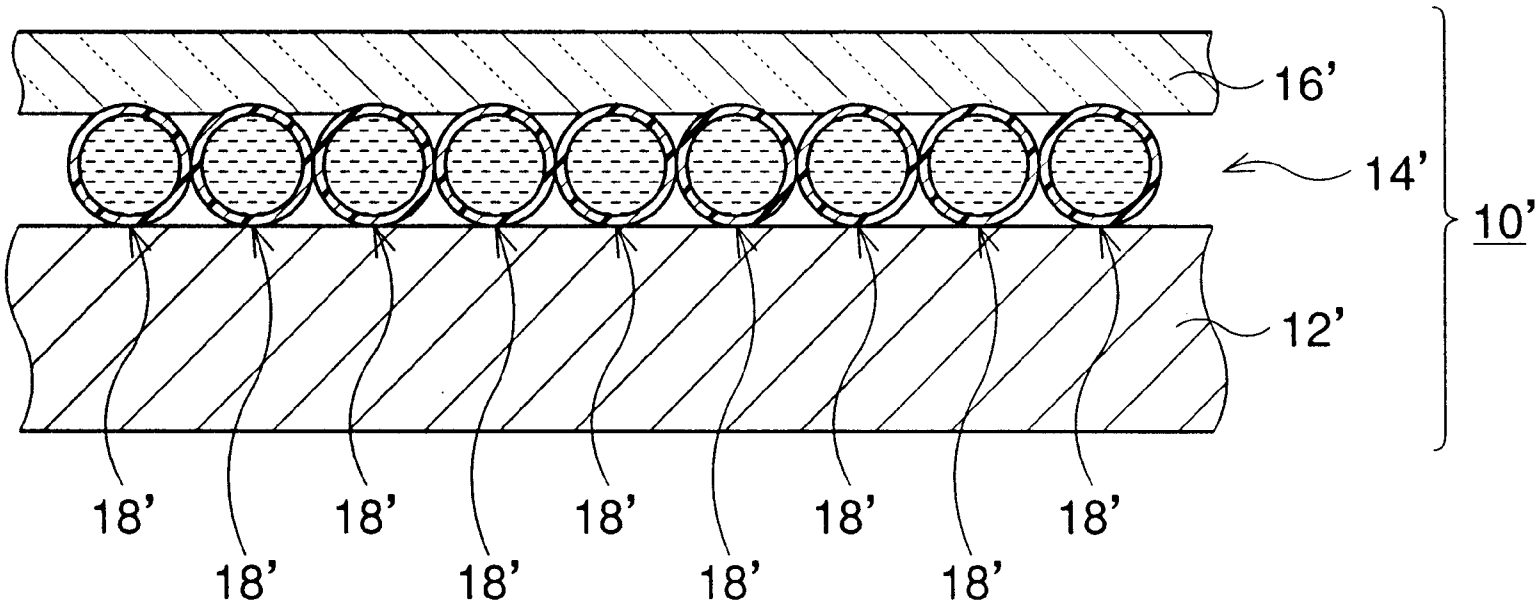
FIG. 15 is a schematic conceptual cross-sectional view showing a second embodiment of an image-forming substrate, according to the present invention, coated with a layer of microcapsules comprising six types of microcapsules filled with dyes exhibiting differing densities.

FIG. 15 shows a second embodiment of an image-forming substrate, generally indicated by reference 10', which is constituted in accordance with the present invention. The image-forming substrate 10' is also produced in a form of paper sheet. Namely, the image-forming substrate or sheet 10' comprises a sheet of paper 12', a layer of microcapsules 14' coated over a surface of the paper sheet 12', and a sheet of protective transparent film 16' covering the microcapsule layer 14'. The microcapsule layer 14' is formed of a plurality of microcapsules 18' comprising six types of microcapsules uniformly distributed over the surface of the paper sheet 12'.

Figure 16:
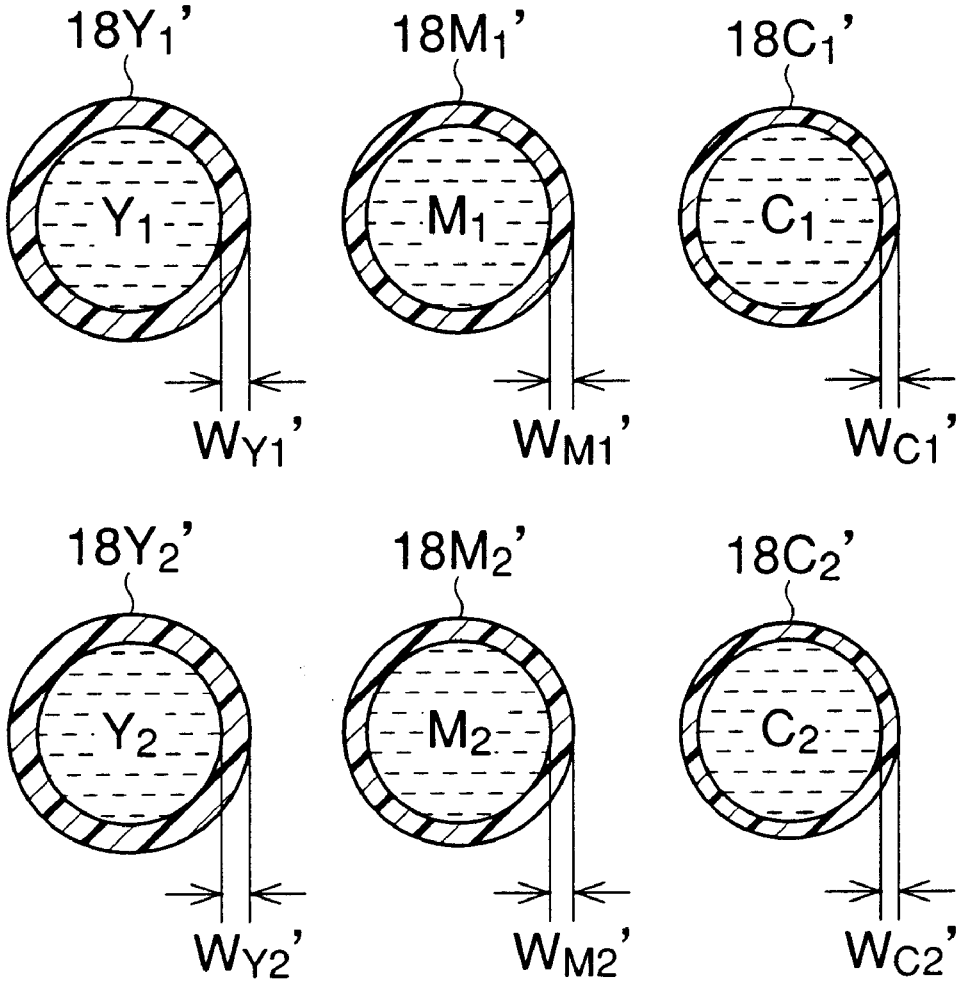
FIG. 16 is a schematic cross-sectional view showing different shell wall thicknesses of the six types of microcapsules included in the layer of microcapsules shown in FIG. 15.

FIG. 16 representatively shows the six types of microcapsules, indicated by references 18$Y_1$', 18$Y_2$', 18$M_1$', 18$M_2$', 18$C_1$' and 18$C_2$'. Similar to the first embodiment, a first type of microcapsules 18$Y_1$' is filled with a first type of yellow liquid dye $Y_1$; a second type of microcapsules 18$Y_2$' is filled with a second type of yellow liquid dye $Y_2$; a third type of microcapsules 18$M_1$' is filled with a first type of magenta liquid dye $M_1$; a fourth type of microcapsules 18$M_2$' is filled with a second type of magenta liquid dye $M_2$; a fifth type of microcapsules 18$C_1$' is filled with a first type of cyan liquid dye $C_1$; and a sixth type of microcapsules 18$C_2$ is filled with a second type of cyan liquid dye $C_2$.

Note, in this second embodiment, the first and second yellow types of liquid dyes $Y_1$ and $Y_2$ exhibit different densities; the first and second types of magenta liquid dyes $M_1$ and $M_2$ exhibit different densities; and the first and second types of cyan liquid dyes $C_1$ and $C_2$ exhibit different densities.

The six types of microcapsules 18$Y_1$', 18$Y_2$', 18$M_1$', 18$M_2$', 18$C_1$' and 18$C_2$' may be produced by the same polymerization method as mentioned previously, and may have an average diameter of several microns, for example, 5 $\mu$m to 10 $\mu$m. Also, by using these six types of microcapsules (18$Y_1$', 18$Y_2$', 18$M_1$', 18$M_2$', 18$C_1$' and 18$C_2$'), the uniform formation of the microcapsule layer 14' is performed in the same manner as mentioned above.

Similar to the first embodiment, for the resin material of each type of microcapsule (18$Y_1$', 18$Y_2$', 18$M_1$', 18$M_2$', 18$C_1$', 18$C_2$'), a shape memory resin is utilized, but these shape memory resins exhibit characteristic longitudinal elasticity coefficients different from those shown in FIG. 4.

Figure 17:
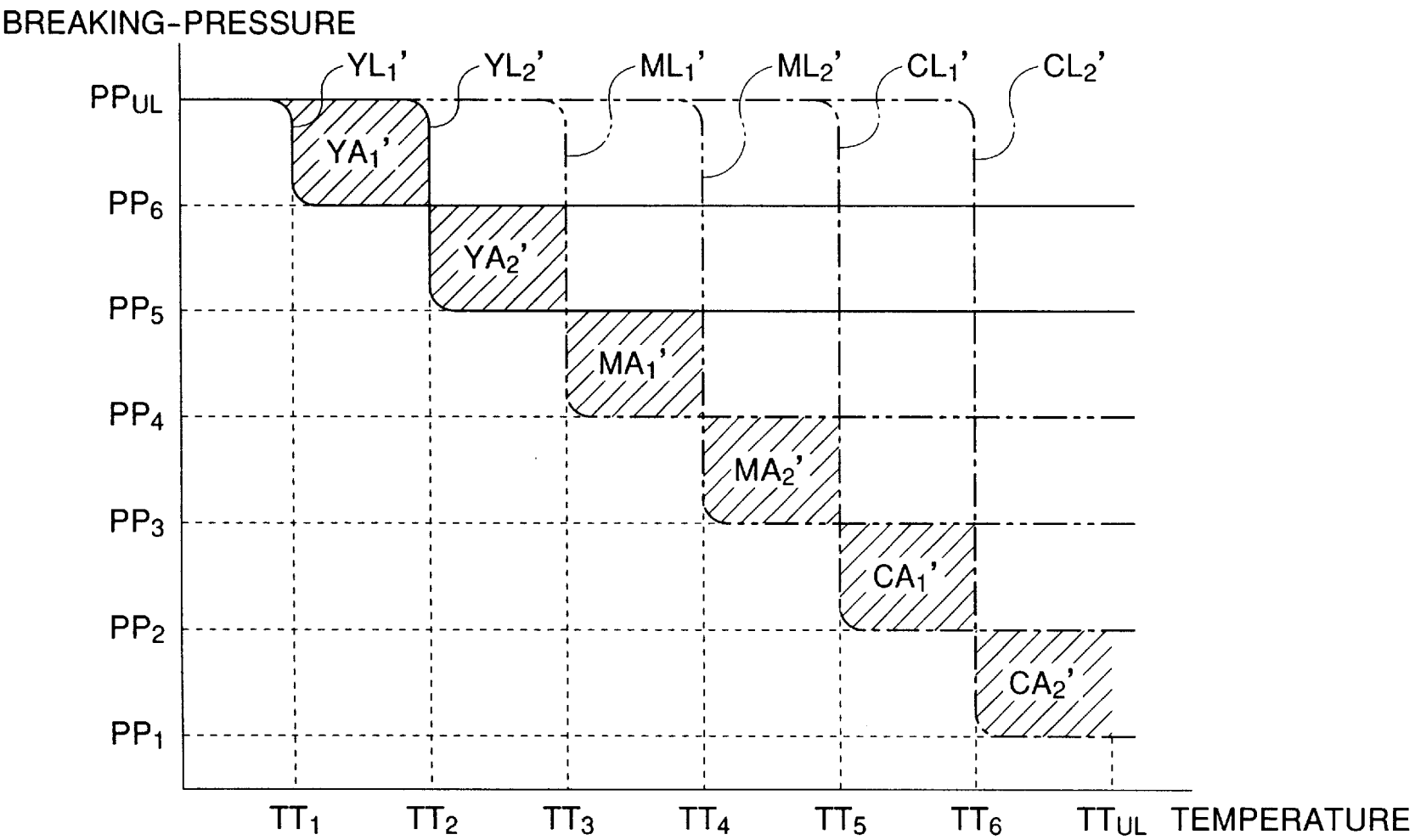
FIG. 17 is a graph showing temperature/pressure compacting characteristics of the six types of microcapsules included in the layer of microcapsules shown in FIG. 15.

In particular, as shown in a graph of FIG. 17, a shape memory resin of the first type of microcapsules 18$Y_1$' is prepared so as to exhibit a characteristic longitudinal elasticity coefficient, indicated by a solid line $YL_1$', having a glass-transition temperature $TT_1$; a shape memory resin of the second type of microcapsules 18$Y_2$' is prepared so as to exhibit a characteristic longitudinal elasticity coefficient, indicated by a solid line $YL_2$', having a glass-transition temperature $TT_2$; a shape memory resin of the third type of microcapsules 18$M_1$' is prepared so as to exhibit a characteristic longitudinal elasticity coefficient, indicated by a double-chained line $ML_1$', having a glass-transition temperature $TT_3$; a shape memory resin of the fourth type of microcapsules 18$M_2$' is prepared so as to exhibit a characteristic longitudinal elasticity coefficient, indicated by a double-chained line $ML_2$', having a glass-transition temperature $TT_4$; a shape memory resin of the fifth type of microcapsules 18$C_1$' is prepared so as to exhibit a characteristic longitudinal elasticity coefficient, indicated by a single-chained line $CL_1$', having a glass-transition temperature $TT_5$; and a shape memory resin of the sixth type of microcapsules 18$C_2$ is prepared so as to exhibit a characteristic longitudinal elasticity coefficient, indicated by a single-chained line $CL_2$', having a glass-transition temperature $TT_6$.

As shown in FIG. 16, the microcapsule walls of the six types of microcapsules 18$Y_1$', 18$Y_2$', 18$M_1$', 18$M_2$', 18$C_1$' and 18$C_2$', respectively, have differing thicknesses $W_{Y1}$', $W_{Y2}$', $W_{M1}$', $W_{M2}$', $W_{C1}$' and $W_{C2}$'. Namely, the thicknesses $W_{Y1}$' and $W_{Y2}$' of the first and second types of microcapsules 18$Y_1$' and 18$Y_2$' are larger than the thicknesses $W_{M1}$' and $W_{M2}$' of the third and fourth types of microcapsules 18$M_1$' and 18$M_2$', and the thicknesses $W_{M1}$' and $W_{M2}$' of the third and fourth types of microcapsules 18$M_1$' and 18$M_2$' are larger than the thicknesses $W_{C1}$' and $W_{C2}$' of the fifth and sixth types of microcapsules 18$C_1$' and 18$C_2$'.

The thickness $W_{Y1}$' of the first type of microcapsules 18$Y_1$' is selected such that each microcapsule 18$Y_1$' is compacted and broken under a breaking pressure that lies between a critical breaking pressure $PP_6$ and an upper limit pressure $PP_{UL}$ (FIG. 17), when each microcapsule 18$Y_1$' is heated to a temperature between the glass-transition temperatures $TT_1$ and $TT_2$. The thickness $W_{Y2}$' of the second type of microcapsules 18$Y_2$' is selected such that each microcapsule 18$Y_2$' is compacted and broken under a breaking pressure that lies between a critical breaking pressure $PP_5$ and the critical breaking pressure $PP_6$ (FIG. 17), when each microcapsule 18$Y_2$' is heated to a temperature between the glass-transition temperatures $TT_2$ and $TT_3$.

The thickness $W_{M1}$' of the third type of microcapsules 18$M_1$' is selected such that each microcapsule 18$M_1$' is compacted and broken under a breaking pressure that lies between a critical breaking pressure $PP_4$ and the critical breaking pressure $PP_5$ (FIG. 17), when each microcapsule 18$M_1$' is heated to a temperature between the glass-transition temperatures $TT_3$ and $TT_4$. The thickness $W_{M2}$' of the fourth type of microcapsules 18$M_2$' is selected such that each microcapsule 18$M_2$' is compacted and broken under a breaking pressure that lies between a critical breaking pressure $PP_3$ and the critical breaking pressure $PP_4$ (FIG. 17), when each microcapsule 18$M_2$' is heated to a temperature between the glass-transition temperatures $TT_4$ and $TT_5$.

The thickness $W_{C1}$' of the fifth type of microcapsules 18$C_1$' is selected such that each microcapsule 18$C_1$ ' is compacted and broken under a breaking pressure that lies between a critical breaking pressure $PP_2$ and the critical breaking pressure $PP_3$ (FIG. 17), when each microcapsule 18$C_1$' is heated to a temperature between the glass-transition temperatures $TT_5$ and $TT_6$ (FIG. 17). The thickness $W_{C2}$' of the sixth type of microcapsules 18$C_2$ is selected such that each microcapsule 18$C_2$' is compacted and broken under a breaking pressure that lies between a critical breaking pressure $PP_1$ and the critical breaking pressure $PP_2$ (FIG. 17), when each microcapsule 18$C_2$' is heated to a temperature between the glass-transition temperature $TT_6$ and an upper limit temperature $TT_{UL}$.

Similar to the first embodiment, the temeperature $TT_1$ is preferably selected from the range of 65° C.–70° C., while the remaining temperatures $TT_2$–$TT_{UL}$ are set at incrementing 20° C. intervals. Thus, if $TT_1$, is 70° C., then $TT_2$, $TT_3$, $TT_4$, $TT_5$, $TT_6$ And $TT_{UL}$ are set to 90° C., 110° C., 130° C., 150° C., 170° C., and 190° C. respectively. Corresponding pressures $PP_1$, $PP_{2,\ PP3}$, $PP_4$, $PP_5$, $PP_6$ And $PP_{UL}$ are, by way of non-limiting example, set to 0.02, 0.1, 0.2, 1.0, 2.0, 10, and 20 MPas, respectively.

For example, if the selected heating temperature and breaking pressure fall within a hatched yellow area $YA_1$' (FIG. 17), defined by a temperature range between the glass-transition temperatures $TT_1$ and $TT_2$ and by a pressure range between the critical breaking pressure $PP_6$ and the upper limit pressure $PP_{UL}$, only the first type of microcapsules 18$Y_1$' is squashed and broken. If the selected heating temperature and breaking pressure fall within a hatched yellow area $YA_2$', defined by a temperature range between the glass-transition temperatures $TT_2$ and $TT_3$ and by a pressure range between the critical breaking pressures $PP_5$ and $PP_6$, only the second type of microcapsules 18$Y_2$' are squashed and broken.

Also, if the selected heating temperature and breaking pressure fall within a hatched magenta area $MA_1$' (FIG. 17), defined by a temperature range between the glass-transition temperatures $TT_3$ and $TT_4$ and by a pressure range between the critical breaking pressures $PP_4$ and $PP_5$, only the third type of microcapsules 18$M_1$' is squashed and broken. If the selected heating temperature and breaking pressure fall within a hatched magenta area $MA_2$', defined by a temperature range between the glass-transition temperatures $TT_4$ and $TT_5$ and by a pressure range between the critical breaking pressures $PP_3$ and $PP_4$, only the fourth type of microcapsules 18$M_2$' is squashed and broken.

Further, if the selected heating temperature and breaking pressure fall within a hatched cyan area $CA_1$' (FIG. 17), defined by a temperature range between the glass-transition temperatures $TT_5$ and $TT_6$ and by a pressure range between the critical breaking pressures $PP_2$ and $PP_3$, only the fifth type of microcapsules 18$C_1$' is squashed and broken. If the selected heating temperature and breaking pressure fall within a hatched cyan area $CA_2$', defined by a temperature range between the glass-transition temperature $TT_6$ and the upper limit temperature $TT_{UL}$ and by a pressure range between the critical breaking pressures $PP_1$ and $PP_2$, only the sixth type of microcapsules 18$C_2$' are squashed and broken.

Figure 18:
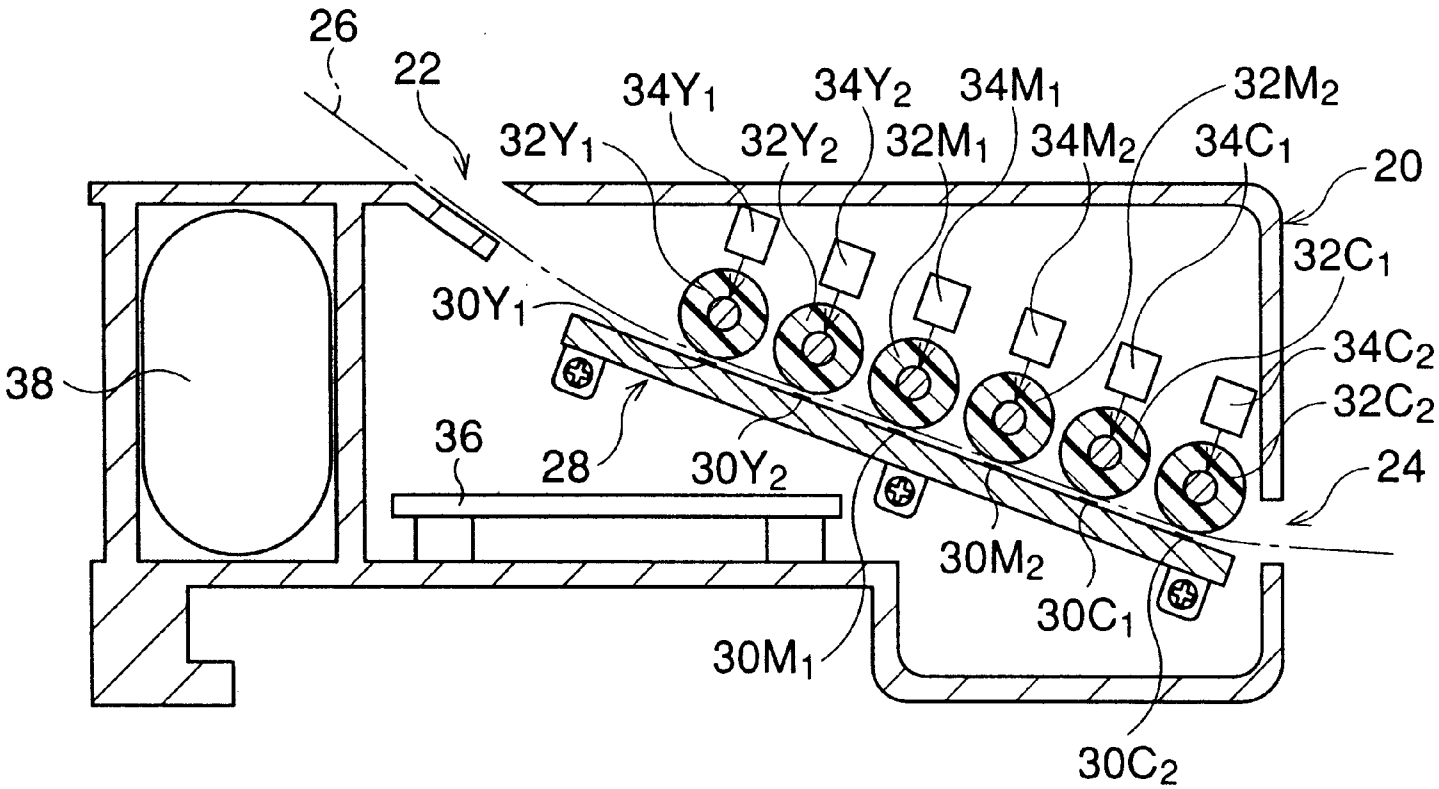
FIG. 18 a schematic cross-sectional view of a color printer for forming a color image on the image-forming substrate shown in FIG. 15.

FIG. 18 schematically shows a thermal color printer, which is constituted as a line printer so as to form a color image on the image-forming sheet 10', which features by the first, second, third, fourth, fifth and sixth types of microcapsules 18$Y_1$', 18$Y_2$', 18$M_1$', 18$M_2$', 18$C_1$' and 18$C_2$'. As is apparent from FIG. 18, this thermal line printer is similar to that shown in FIG. 5, and thus, in this drawing, the features similar to those of FIG. 5 are indicated by the same reference numerals.

The color printer also comprises a generally-rectangular parallelopiped housing 20 having an entrance opening 22 and an exit opening 24 formed in a top wall and a side wall of the housing 20, respectively. The image-forming sheet 10' (not shown in FIG. 18) is introduced into the housing 20 through the entrance opening 22, and is then discharged from the exit opening 24 after the formation of a color image on the image-forming sheet 10'. Note, in FIG. 18, a path 26 for movement of the image-forming sheet 10' is indicated by a chained line.

A guide plate 28 is provided in the housing 20 so as to define a part of the path 26 for the movement of the image-forming sheet 10', and a first set of thermal heads 30$Y_1$ and 30$Y_2$, a second set of thermal heads 30$M_1$ and 30$M_2$ and a third thermal heads 30$C_1$ and 30$C_2$ are securely attached to a surface of the guide plate 28. These thermal heads 30$Y_1$ and 30$Y_2$; 30$M_1$ and 30$M_2$; and 30$C_1$ and 30$C_2$ are essentially identical to each other, and each thermal head is formed as a line thermal head extending perpendicularly with respect to a direction of movement of the image-forming sheet 10'. Each of the thermal heads 30$Y_1$ and 30$Y_2$; 30$M_1$ and 30$M_2$; and 30$C_1$ and 30$C_2$ includes a plurality of heater elements or electric resistance elements, and these electric resistance elements are aligned with each other along a length of the corresponding line thermal head (30$Y_1$, 30$Y_2$; 30$M_1$, 30$M_2$; 30$C_1$, 30$C_2$).

The first set of thermal heads 30$Y_1$ and 30$Y_2$ is used to form a yellow-dotted image on the image-forming sheet 10', and a pair of corresponding electric resistance elements, included in the thermal heads 30$Y_1$ and 30$Y_2$, is selectively and electrically energized to produce a yellow-image-pixel dot in accordance with a digital yellow image-pixel signal carrying a 2-bit digital gradation signal. When the digital yellow image-pixel signal has a value "0", the corresponding pair of electric resistance elements are not electrically energized. When the digital yellow image-pixel signal has a value "1", at least one of the corresponding pair of electric resistance elements is electrically energized in accordance with the 2-bit digital gradation signal carried by the digital yellow image-pixel signal. In either case, whenever one of the electric resistance elements, included in the thermal head 30$Y_1$, is electrically energized, it is heated to a temperature between the glass-transition temperatures $TT_1$ and $TT_2$. Also, whenever one of the electric resistance elements, included in the thermal head 30$Y_2$ is electrically energized, it is heated to a temperature between the glass-transition temperatures $TT_2$ and $TT_3$.

The second set of thermal heads 30$M_1$ and 30$M_2$ is used to form a magenta-dotted image on the image-forming sheet 10', and a pair of corresponding electric resistance elements, included in the thermal heads 30$M_1$ and 30$M_2$, is selectively and electrically energized to produce a magenta-image-pixel dot in accordance with a digital magenta image-pixel signal carrying a 2-bit digital gradation signal. When the digital magenta image-pixel signal has a value "0", the corresponding pair of electric resistance elements are not electrically energized. When the digital magenta image-pixel signal has a value "1", at least one of the corresponding pair of electric resistance elements is electrically energized in accordance with the 2-bit digital gradation signal carried by the digital magenta image-pixel signal. In either case, whenever one of the electric resistance elements, included in the thermal head 30$M_1$, is electrically energized, it is heated to a temperature between the glass-transition temperatures $TT_3$ and $TT_4$. Also, whenever one of the electric resistance elements, included in the thermal head 30$M_2$ is electrically energized, it is heated to a temperature between the glass-transition temperatures $TT_4$ and $TT_5$.

The third set of thermal heads 30$C_1$ and 30$C_2$ is used to form a cyan-dotted image on the image-forming sheet 10', and a pair of corresponding electric resistance elements, included in the thermal heads 30$C_1$ and 30$C_2$, is selectively and electrically energized to produce a cyan-image-pixel dot in accordance with a digital cyan image-pixel signal carrying a 2-bit digital gradation signal. When the digital cyan image-pixel signal has a value "0", the corresponding pair of electric resistance elements are not electrically energized. When the digital cyan image-pixel signal has a value "1", at least one of the corresponding pair of electric resistance elements is electrically energized in accordance with the 2-bit digital gradation signal carried by the digital cyan image-pixel signal. In either case, whenever one of the electric resistance elements, included in the thermal head 30$C_1$, is electrically energized, it is heated to a temperature between the glass-transition temperatures $TT_5$ and $TT_6$. Also, whenever one of the electric resistance elements, included in the thermal head 30$C_2$ is electrically energized, it is heated to a temperature between the glass-transition temperature $TT_6$ and the upper limit temperature $TT_{UL}$.

Note, the line thermal heads 30$Y_1$ and 30$Y_2$; 30$M_1$ and 30$M_2$; and 30$C_1$ and 30$C_2$ are arranged in sequence so that the respective heating temperatures increase in the movement direction of the image-forming sheet 10'.

The color printer further comprises a first set of roller platens 32$Y_1$ and 32$Y_2$ associated with the first set of thermal heads 30$Y_1$ and 30$Y_2$, a second set of roller platens 32$M_1$ and 32$M_2$ associated with the second set thermal heads 30$M_1$ and 30$M_2$, and a third set of roller platens 32$C_1$ and 32$C_2$ associated with the third set of thermal heads 30$C_1$ and 30$C_2$, and each of the roller platens 32$Y_1$ and 32$Y_2$; 32$M_1$ and 32$M_2$; and 32$C_1$ and 30$C_2$ may be formed of a suitable hard rubber material.

The first set of roller platens 32$Y_1$ and 32$Y_2$ is provided with a first set of spring-biasing units 34$Y_1$ and 34$Y_2$. The roller platen $32Y_1$ is elastically pressed against the thermal head $30Y_1$ by the spring-biasing unit $34Y_1$ at a pressure between the critical compacting-pressure $PP_6$ and the upper limit pressure $PP_{UL}$, and the roller platen $32Y_2$ is elastically pressed against the thermal head $30Y_2$ by the spring-biasing unit $34Y_2$ at a pressure between the critical compacting-pressures $PP_5$ and $PP_6$.

The second set of roller platens $32M_1$ and $32M_2$ is provided with a second set of spring-biasing units $34M_1$ and $34M_2$. The roller platen $32M_1$ is elastically pressed against the thermal head $30M_1$ by the spring-biasing unit $34M_1$ at a pressure between the critical compacting-pressures $PP_4$ and $PP_5$, and the roller platen $32M_2$ is elastically pressed against the thermal head $30M_2$ by the spring-biasing unit $34M_2$ at a pressure between the critical compacting-pressures $PP_3$ and $PP_4$.

The third set of roller platens $32C_1$ and $32C_2$ is provided with a third set of spring-biasing units $34C_1$ and $34C_2$. The roller platen $32C_1$ is elastically pressed against the thermal head $30C_1$ by the spring-biasing unit $34C_1$ at a pressure between the critical compacting-pressures $PP_2$ and $PP_3$, and the roller platen $32C_2$ is elastically pressed against the thermal head $30C_2$ by the spring-biasing unit $34C_2$ at a pressure between the critical compacting-pressures $PP_1$ and $PP_2$.

Note, the roller platens $32Y_1$ and $32Y_2$; $32M_1$ and $32M_2$; and $32C_1$ and $32C_2$ are arranged in sequence so that the respective pressures, exerted by the platens $32Y_1$ and $32Y_2$; $32M_1$ and $32M_2$; and $32C_1$ and $32C_2$ on the line thermal heads $30Y_1$ and $30Y_2$; $30M_1$ and $30M_2$; and $30C_1$ and $30C_2$, decrease in the movement direction of the image-forming sheet 10'.

In FIG. 18, reference 36 indicates a control circuit board for controlling a printing operation of the color printer, and reference 38 indicates an electrical main power source for electrically energizing the control circuit board 36.

Figure 19:
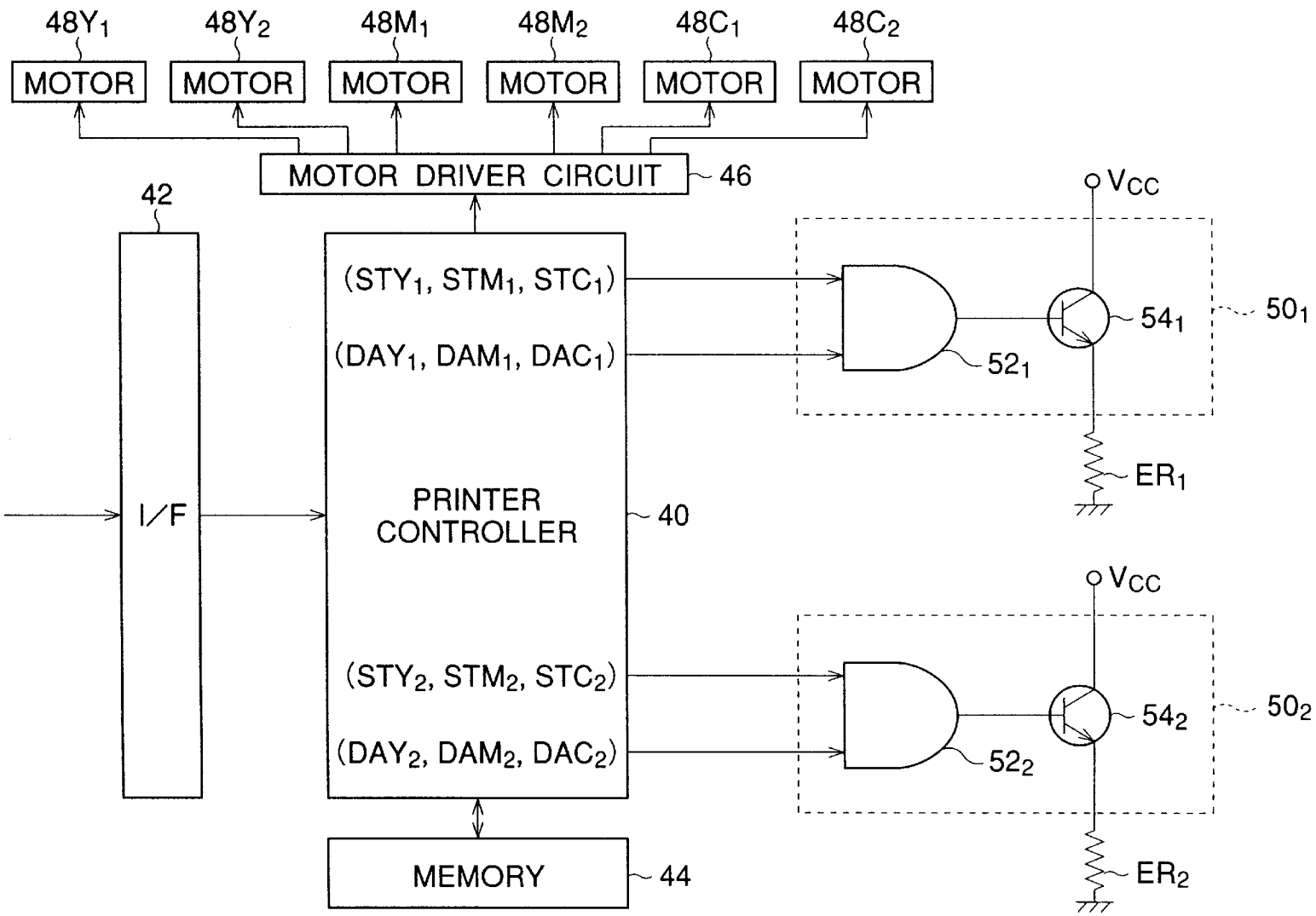
FIG. 19 is a partial schematic block diagram of a control circuit for the color printer of FIG. 18, which shows representatively a set of driver circuits used in three sets of line thermal heads of the color printer.

FIG. 19 shows a part of a schematic block diagram of the control circuit board 36. As shown in this drawing, the control circuit board 36 comprises a printer controller 40 including a microcomputer. The printer controller 40 receives a series of digital color image-pixel signals from a personal computer or a word processor (not shown) through an interface circuit (I/F) 42, with each of the digital color image-pixel signals carrying a digital 2-bit gradation-signal. The received digital color image-pixel signals (i.e., digital cyan image-pixel signals carrying 2-bit digital gradation signals, digital magenta image-pixel signals carrying 2-bit digital gradation signals, and digital yellow image-pixel signals carrying 2-bit digital gradation signals) are once stored in a memory 44.

Also, the control circuit board 36 is provided with a motor driver circuit 46 for driving a first set of electric motors $48Y_1$ and $48Y_2$, a second set of electric motors $48M_1$ and $48M_2$ and a third set of electric motors $48C_1$ and $48C_2$, which are used to rotationally drive the first set of roller platens $32Y_1$ and $32Y_2$, the second set of roller platens $32M_1$ and $32M_2$ and the third roller platens $32C_1$ and $32C_2$, respectively. Each of the motors $48Y_1$ and $48Y_2$; $48M_1$ and $48M_2$; and $48C_1$ and $48C_2$ is a stepping motor, which is driven in accordance with a series of drive pulses outputted from the motor driver circuit 46, the outputting of drive pulses from the motor driver circuit 46 to the motors $48Y_1$ and $48Y_2$; $48M_1$ and $48M_2$; and $48C_1$ and $48C_2$ being controlled by the printer controller 40.

During a printing operation, the respective roller platens $32Y_1$ and $32Y_2$; $32M_1$ and $32M_2$; and $32C_1$ and $32C_2$ are rotated in a counterclockwise direction (FIG. 18) by the motors $48Y_1$ and $48Y_2$; $48M_1$ and $48M_2$; and $48C_1$ and $48C_2$, with a same peripheral speed. Accordingly, the image-forming sheet 10', introduced through the entrance opening 22, moves toward the exit opening 24 along the path 26.

Thus, the image-forming sheet 10' is subjected to pressure ranging between the critical compacting-pressure $PP_6$ and the upper limit pressure $PP_{UL}$ when passing between the thermal head $30Y_1$ and the roller platen $32Y_1$; to pressure ranging between the critical compacting-pressures $PP_5$ and $PP_6$ when passing between the thermal head $30Y_2$ and the roller platen $32Y_2$; to pressure ranging between the critical compacting-pressures $PP_4$ and $PP_5$ when passing between the thermal head $30M_1$ and the roller platen $32M_1$; to pressure ranging between the critical compacting-pressures $PP_3$ and $PP_4$ when passing between the thermal head $30M_2$ and the roller platen $32M_2$; to pressure ranging between the critical compacting-pressures $PP_2$ and $PP_3$ when passing between the thermal head $30C_1$ and the roller platen $32C_1$; and to pressure ranging between the critical compacting-pressures $PP_1$ and $PP_2$ when passing between the thermal head $30C_2$ and the roller platen $32C_2$.

Note, similar to the first embodiment, the introduction of the image-forming sheet 10' into the entrance opening 22 of the printer is carried out such that the transparent protective film sheet 16' of the image-forming sheet 10' comes into contact with the thermal heads $30Y_1$ and $30Y_2$; $30M_1$ and $30M_2$; and $30C_1$ and $30C_2$.

In FIG. 19, only one pair of corresponding electric resistance elements, included in each set of thermal heads ($30Y_1$ and $30Y_2$; $30M_1$ and $30M_2$; $30C_1$ and $30C_2$) is representatively illustrated, and the corresponding pair of electric resistance elements is indicated by references $ER_1$ and $ER_2$. The respective corresponding electric resistance elements $ER_1$ and $ER_2$ are selectively and electrically energized by driver circuits $50_1$ and $50_2$ under control of the printer controller 40.

The driver circuit $50_1$ includes an AND-gate circuit $52_1$ and a transistor $54_1$. As shown in FIG. 19, a set of a strobe signal ($STY_1$, $STM_1$ or $STC_1$) and a control signal ($DAY_1$, $DAM_1$ or $DAC_1$) is inputted from the printer controller 40 to two input terminals of the AND-gate circuit $52_1$. A base of the transistor $54_1$ is connected to an output terminal of the AND-gate circuit $52_1$; a collector of the transistor $54_1$ is connected to an electric power source ($V_{cc}$); and an emitter of the transistor $54_1$ is connected to the electric resistance element $ER_1$.

Similarly, the driver circuit $50_2$ includes an AND-gate circuit $52_2$ and a transistor $54_2$. As shown in FIG. 19, a set of a strobe signal ($STY_2$, $STM_2$ or $STC_2$) and a control signal ($DAY_2$, $DAM_2$ or $DAC_2$) is inputted from the printer controller 40 to two input terminals of the AND-gate circuit $52_2$. A base of the transistor $54_2$ is connected to an output terminal of the AND-gate circuit $52_2$; a collector of the transistor $54_2$ is connected to an electric power source ($V_{cc}$); and an emitter of the transistor $54_2$ is connected to the electric resistance element $ER_2$.

When the corresponding pair of electric resistance elements $ER_1$ and $ER_2$, as shown in FIG. 19, is one included in the first set of thermal heads $30Y_1$ and $30Y_2$, first, a set of a strobe signal "$STY_1$" and a control signal "$DAY_1$" is outputted from the printer controller 40, and is then inputted to the input terminals of the AND-gate circuit $52_1$, during a printing operation. As shown in a timing chart of FIG. 20, the strobe signal "$STY_1$" has a pulse width "$PWY_1$", and the control signal "$DAY_1$" is varied in accordance with binary values of a digital yellow image-pixel signal "Y" and a 2-bit digital gradation signal "GSY" carried thereby, as shown in a table of FIG. 21.

Figures 20, 21:
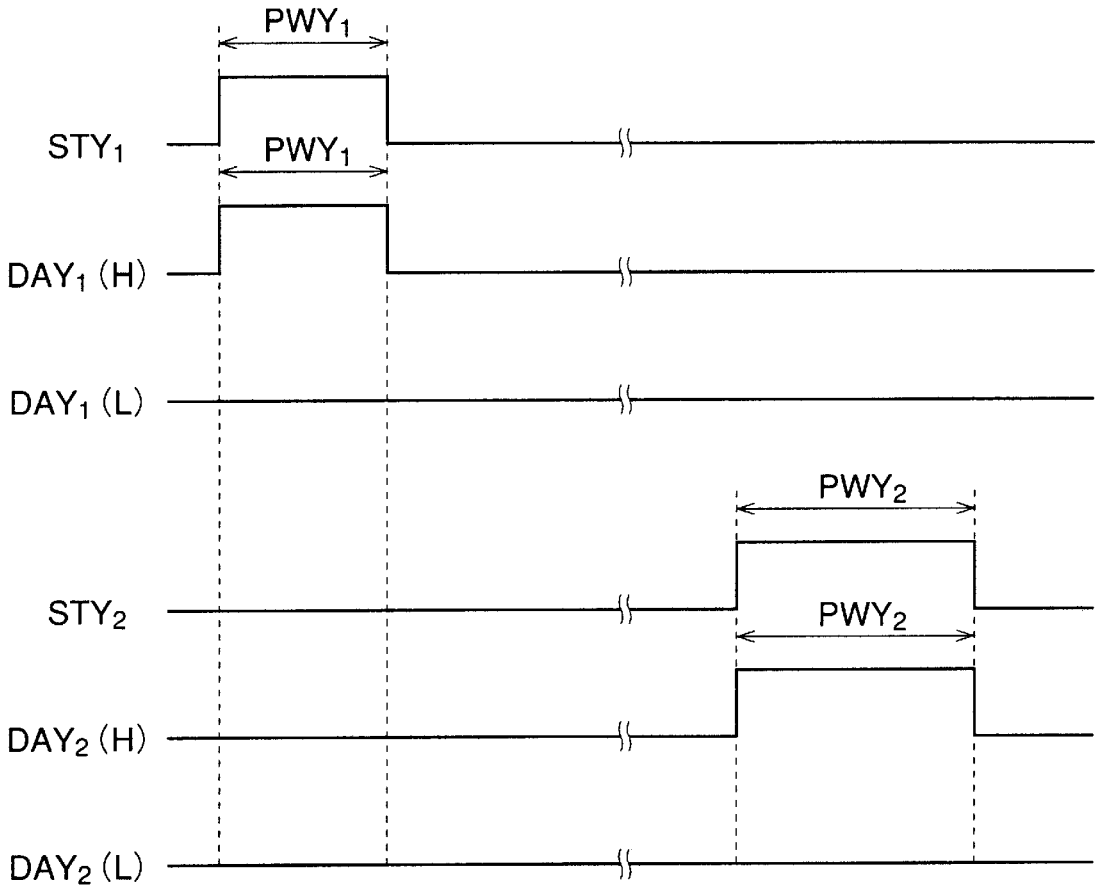
FIG. 20 is a timing chart showing a set of strobe signals and a set of control signals for electronically actuating the set of thermal head driver circuits for producing a yellow dot on the image-forming substrate of FIG. 15.
FIG. 21 is a table showing a relationship between a digital yellow image-pixel signal carrying a 2-bit gradation-signal for producing the set of control signals and a variation of the sets of control signals caused by a combination of the digital yellow image-pixel signal and the 2-bit gradation-signal.

As is apparent from the table of FIG. 21, if the digital yellow image-pixel signal "Y" has a value "0", and if the 2-bit digital gradation signal "GSY" has a value [00], the control signal "$DAY_1$" is maintained at a low-level under control of the printer controller 40 (FIGS. 20 and 21). Also, if the digital yellow image-pixel signal "Y" has a value "1", and if the 2-bit digital gradation signal "GSY" has a value [10], the control signal "$DAY_1$" is maintained at a low-level under control of the printer controller 40 (FIGS. 20 and 21).

If the digital yellow image-pixel signal has a value "1", and if the 2-bit digital gradation signal "GSY" has either a value [01] or a value [11], the control signal "$DAY_1$" is outputted, as a high-level pulse (H) having the same pulse width "$PWY_1$" as that of the strobe signal "$STY_1$", from the printer controller 40. Thus, the electric resistance element $ER_1$ is electrically energized during a period corresponding to the pulse width "$PWY_1$" of the high-level pulse of the control signal "$DAY_1$", whereby the electric resistance element $ER_1$ is heated to the temperature between the glass-transition temperatures $TT_1$ and $TT_2$. Accordingly, in a dot area, defined by the electric resistance element $ER_1$, on the image-forming sheet 10', only the microcapsules 18$Y_1$' are compacted and broken, resulting in seepage of the first type of yellow liquid dye $Y_1$ from the compacted and broken microcapsules 18$Y_1$'.

When the image-forming sheet 10' has been moved over a given period of time, i.e. when the dot area defined by the electric resistance element $ER_1$ has reached a location at which a dot area should be defined on the image-forming sheet 10' by the electric resistance element $ER_2$, a set of a strobe signal "$STY_2$" and a control signal "$DAY_2$" is outputted from the printer controller 40, and is then inputted to the input terminals of the AND-gate circuit $\mathbf{52}_2$. As shown in the timing chart of FIG. 20, the strobe signal "$STY_2$" has a pulse width "$PWY_2$", being longer than that of the strobe signal "$STY_1$", and the control signal "$DAY_2$" is varied in accordance with binary values of the same digital yellow image-pixel signal "Y" carrying the 2-bit digital gradation signal "GSY" as mentioned above and shown in the table of FIG. 21.

As is apparent from the table of FIG. 21, if the digital yellow image-pixel signal "Y" has a value "0", and if the 2-bit digital gradation signal "GSY" has a value [00], the control signal "$DAY_2$" is maintained at a low-level under control of the printer controller 40 (FIGS. 20 and 21). In this case, the dot area, defined by both the electric resistance elements $ER_1$ and $ER_2$, is colored by neither the first or second types of yellow dyes $Y_1$ and $Y_2$, due to the low-level of the control signal "$DAY_1$" ("Y"=[0] and "GSY"=[00]). Namely, the dot area concerned is produced as a white dot on the image-forming sheet 10'.

Figure 22:
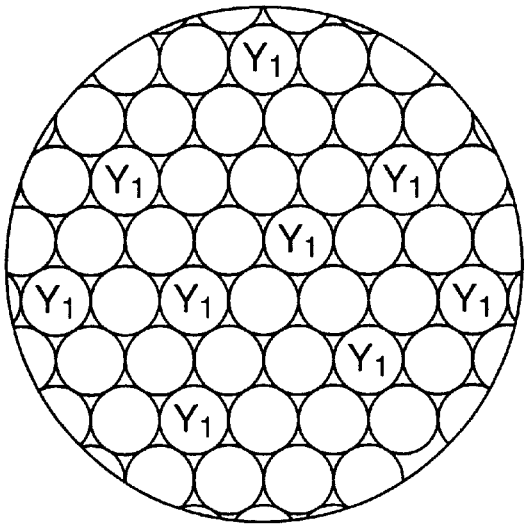
FIG. 22 is a conceptual view showing an example of variation in density (gradation) of a yellow dot produced on the image-forming substrate of FIG. 15.

If the digital yellow image-pixel signal "Y" has a value "1", and if the 2-bit digital gradation signal "GSY" has a value [01], the control signal "$DAY_2$" is maintained at a low-level under control of the printer controller 40 (FIGS. 20 and 21). In this case, the dot area, defined by both the electric resistance elements $ER_1$ and $ER_2$, is colored by only the first type of yellow dye $Y_1$, as shown in FIG. 22, due to the high-level of the control signal "$DAY_1$" (i.e. "Y"=[1] and "GSY"=[01]). Namely, the dot area concerned is produced as a yellow dot on the image-forming sheet 10', and the yellow dot exhibits a first yellow density resulting from only the seeped yellow dye $Y_1$.

Figure 23:
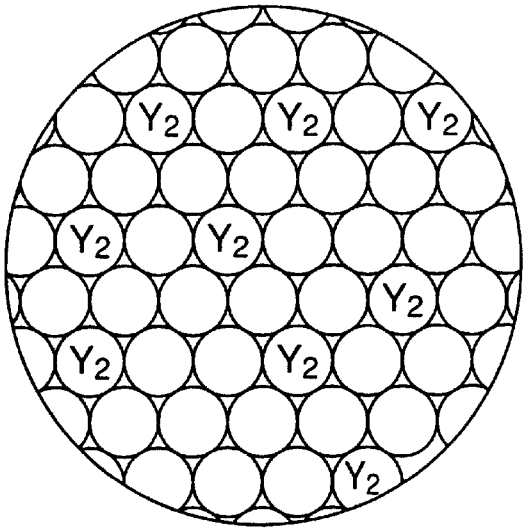
FIG. 23 is a conceptual view showing another example of variation in density (gradation) of a yellow dot produced on the image-forming substrate of FIG. 15.

If the digital yellow image-pixel signal has a value "1", and if the 2-bit digital gradation signal "GSY" has a value [10], the control signal "$DAY_2$" is outputted, as a high-level pulse (H) having the same pulse width "$PWY_2$" as that of the strobe signal "$STY_2$", from the printer controller 40. Thus, the electric resistance element $ER_2$ is electrically energized during a period corresponding to the pulse width "$PWY_2$" of the high-level pulse of the control signal "$DAY_2$", whereby the electric resistance element $ER_2$ is heated to the temperature between the glass-transition temperatures $TT_2$ and $TT_3$. Thus, in the dot area defined by both the electric resistance elements $ER_1$ and $ER_2$, only the microcapsules 18$Y_2$' are compacted and broken, resulting in seepage of the second type of yellow liquid dye $Y_2$ from the compacted and broken microcapsules 18$Y_2$'. In this case, the dot area, defined by both the electric resistance elements $ER_1$ and $ER_2$, is colored by only the second type of yellow dye $Y_2$, as shown in FIG. 23, due to the low-level of the control signal "$DAY_1$" ("Y"=[1] and "GSY"=[10]). Namely, the dot area concerned is produced as a yellow dot on the image-forming sheet 10', and the yellow dot exhibits a second yellow density resulting from only the seeped yellow dye $Y_2$.

Figure 24:
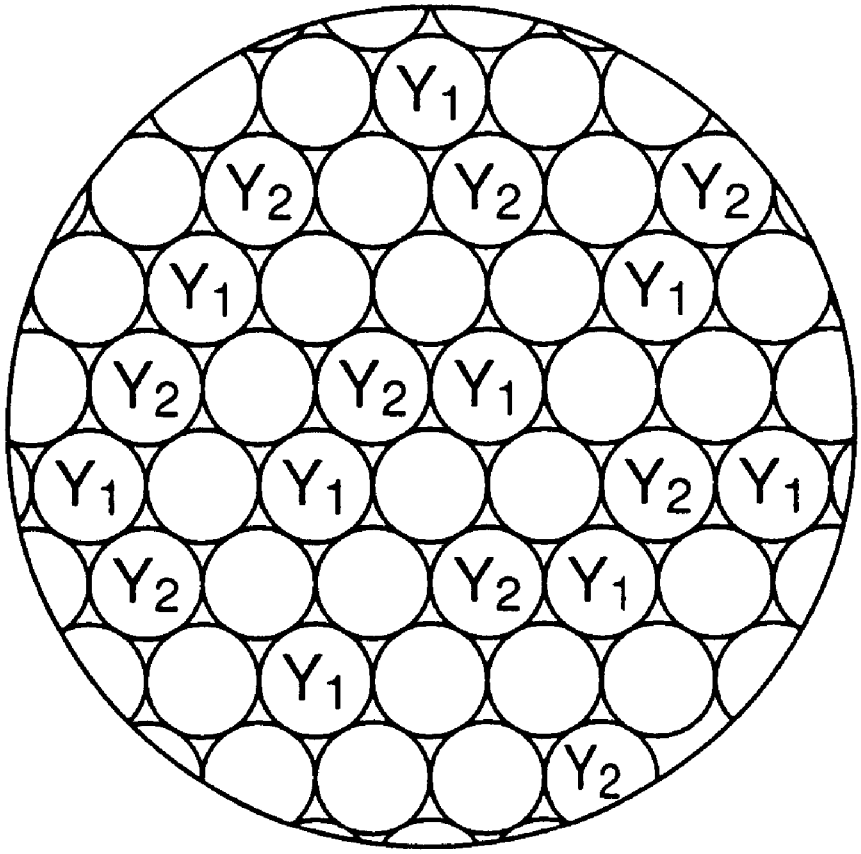
FIG. 24 is a conceptual view showing yet another example of variation in density (gradation) of a yellow dot produced on the image-forming substrate of FIG. 15.

If the digital yellow image-pixel signal has a value "1", and if the 2-bit digital gradation signal "GSY" has a value [11], the control signal "$DAY_2$" is outputted, as a high-level pulse (H) having the same pulse width "$PWY_2$" as that of the strobe signal "$STY_2$", from the printer controller 40. Thus, the electric resistance element $ER_2$ is electrically energized during a period corresponding to the pulse width "$PWY_2$" of the high-level pulse of the control signal "$DAY_2$", whereby the electric resistance element $ER_2$ is heated to the temperature between the glass-transition temperatures $TT_2$ and $TT_3$. Thus, in the dot area defined by both the electric resistance elements $ER_1$ and $ER_2$, the microcapsules 18$Y_2$' are compacted and broken, resulting in seepage of the second type of yellow liquid dye $Y_2$ from the compacted and broken microcapsules 18$Y_2$'. In this case, the dot area, defined by both the electric resistance elements $ER_1$ and $ER_2$, is colored by both the first and second types of yellow dyes $Y_1$ and $Y_2$, as shown in FIG. 24, due to the high-level of the control signal "$DAY_1$" and "$DAY_2$" ("Y"=[1] and "GSY"=[11]). Namely, the dot area concerned is produced as a yellow dot on the image-forming sheet 10', and the yellow dot exhibits a third yellow density resulting from a mixture of the seeped yellow dyes $Y_1$ and $Y_2$.

As is apparent from the foregoing, by selectively seeping the first and second types of yellow dyes $Y_1$ and $Y_2$ from the first and second microcapsules 18$Y_1$' and 18$Y_2$', it is possible to obtain a variation in density (gradation) of the yellow dot.

Figures 25, 26:
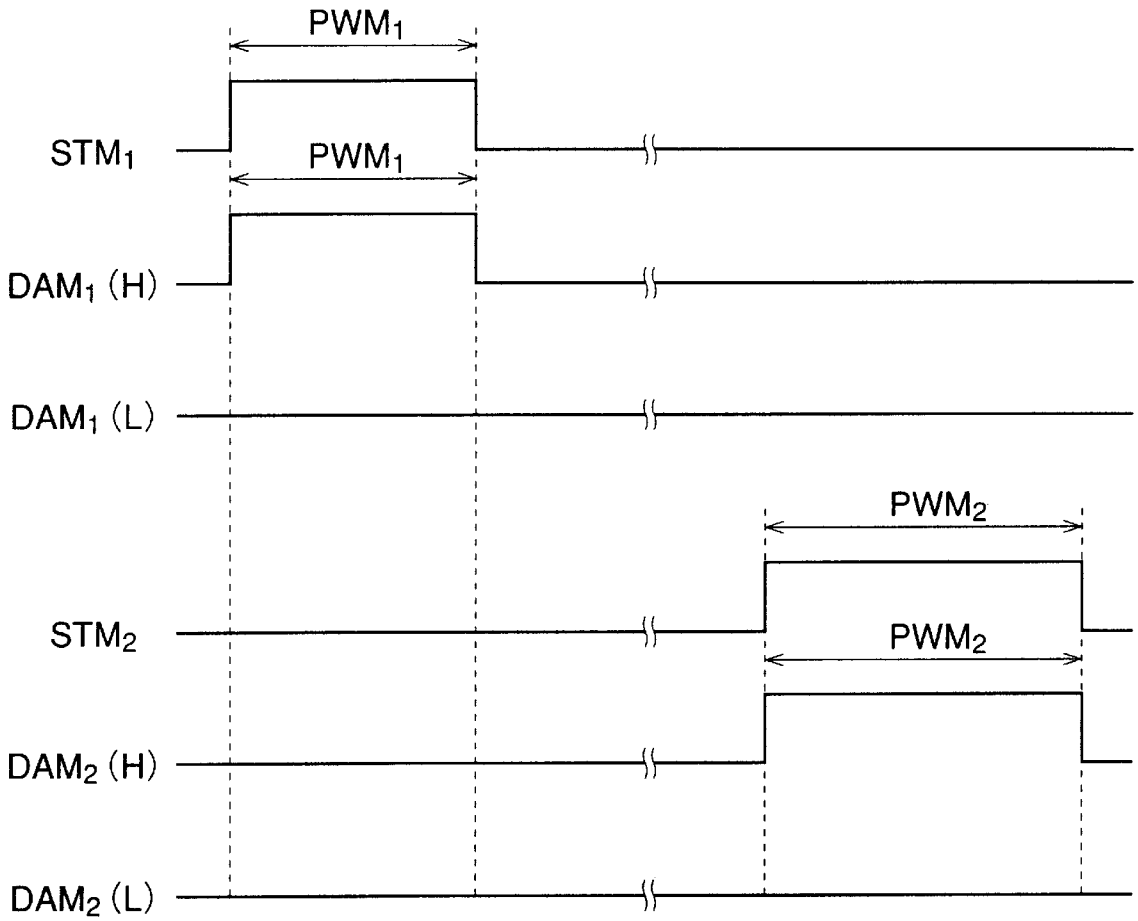
FIG. 25 is a timing chart showing a set of strobe signals and a set of control signals for electronically actuating the set of thermal head driver circuits for producing a magenta dot on the image-forming substrate of FIG. 15.
FIG. 26 is a table showing a relationship between a digital magenta image-pixel signal carrying a 2-bit gradation-signal for producing the set of control signals and a variation of the sets of control signals caused by a combination of the digital magenta image-pixel signal and the 2-bit gradation-signal.

When the corresponding pair of electric resistance elements $ER_1$ and $ER_2$, as shown in FIG. 19, is one included in the second set of thermal heads $\mathbf{30}M_1$ and $\mathbf{30}M_2$, the selective and electrical energization of the electric resistance elements $ER_1$ and $ER_2$ is performed in substantially the same manner as mentioned above and shown in a timing chart of FIG. 25 and a table of FIG. 26, whereby a variation in density (gradation) of the magenta dot is obtainable.

In particular, if a digital magenta image-pixel signal "M" has a value "0", and if a 2-bit digital gradation signal "GSM" has a value [00], the electric resistance elements $ER_1$ and $ER_2$ cannot be electrically energized. Thus, a dot area, defined by both the electric resistance elements $ER_1$ and $ER_2$, is produced as a white dot on the image-forming sheet 10'.

If the digital magenta image-pixel signal "M" has a value "1", and if the 2-bit digital gradation signal "GSM" has a value [01], only the electric resistance element $ER_1$ is electrically energized during a period corresponding to a pulse width "$PWM_1$" of a high-level pulse of a control signal "$DAM_1$" which is equal to that of a strobe signal "$STM_1$", being longer than that of the strobe signal "$STY_2$", whereby the electric resistance element $ER_1$ is heated to the temperature between the glass-transition temperatures $TT_3$ and $TT_4$. On the other hand, the electric resistance element $ER_2$ is not electrically energized. Thus, in a dot area, defined by both the electric resistance elements $ER_1$ and $ER_2$, on the image-forming sheet 10', only the microcapsules 18$M_1$' are compacted and broken, resulting in seepage of the first type of magenta liquid dye $M_1$ from the compacted and broken microcapsules 18$M_1$'. In this case, the dot area, defined by both the electric resistance elements $ER_1$ and $ER_2$, is colored by only the first type of magenta dye $M_1$. Namely, the dot area concerned is produced as a magenta dot on the image-forming sheet 10', and the magenta dot exhibits a first magenta density resulting from only the seeped magenta dye $M_1$.

If the digital magenta image-pixel signal "M" has a value "1", and if the 2-bit digital gradation signal "GSM" has a value [10], the electric resistance element $ER_1$ is not electrically energized. On the other hand, the electric resistance element $ER_2$ is electrically energized during a period corresponding to a pulse width "$PWM_2$" of a high-level pulse of a control signal "$DAM_2$", which is equal to that of a strobe signal "$STM_2$", being longer than that of the strobe signal "$STM_1$", whereby the electric resistance element $ER_2$ is heated to the temperature between the glass-transition temperatures $TT_4$ and $TT_5$. Thus, in a dot area defined by both the electric resistance elements $ER_1$ and $ER_2$, only the microcapsules 18$M_2$' are compacted and broken, resulting in seepage of the second type of magenta liquid dye $M_2$ from the compacted and broken microcapsules 18$M_2$'. In this case, a dot area, defined by both the electric resistance elements $ER_1$ and $ER_2$, is colored by only the second type of magenta dye $M_2$. Namely, the dot area concerned is produced as a magenta dot on the image-forming sheet 10', and the magenta dot exhibits a second magenta density resulting from only the seeped magenta dye $M_2$.

If the digital magenta image-pixel signal "M" has a value "1", and if the 2-bit digital gradation signal "GSM" has a value [11], electrical energization of both the electric resistance elements $ER_1$ and $ER_2$ is carried out. Thus, in a dot area defined by both the electric resistance elements $ER_1$ and $ER_2$, both the microcapsules 18$M_1$' and 18$M_2$' are compacted and broken, resulting in seepage of the first and second types of magenta liquid dyes $M_1$ and $M_2$ from the compacted and broken microcapsules 18$M_1$' and 18$M_2$'. In this case, the dot area, defined by both the electric resistance elements $ER_1$ and $ER_2$, is colored by both the first and second types of magenta dyes $M_1$ and $M_2$. Namely, the dot area concerned is produced as a magenta dot on the image-forming sheet 10', and the magenta dot exhibits a third magenta density resulting from a mixture of the seeped magenta dyes $M_1$ and $M_2$.

Figures 27, 28:
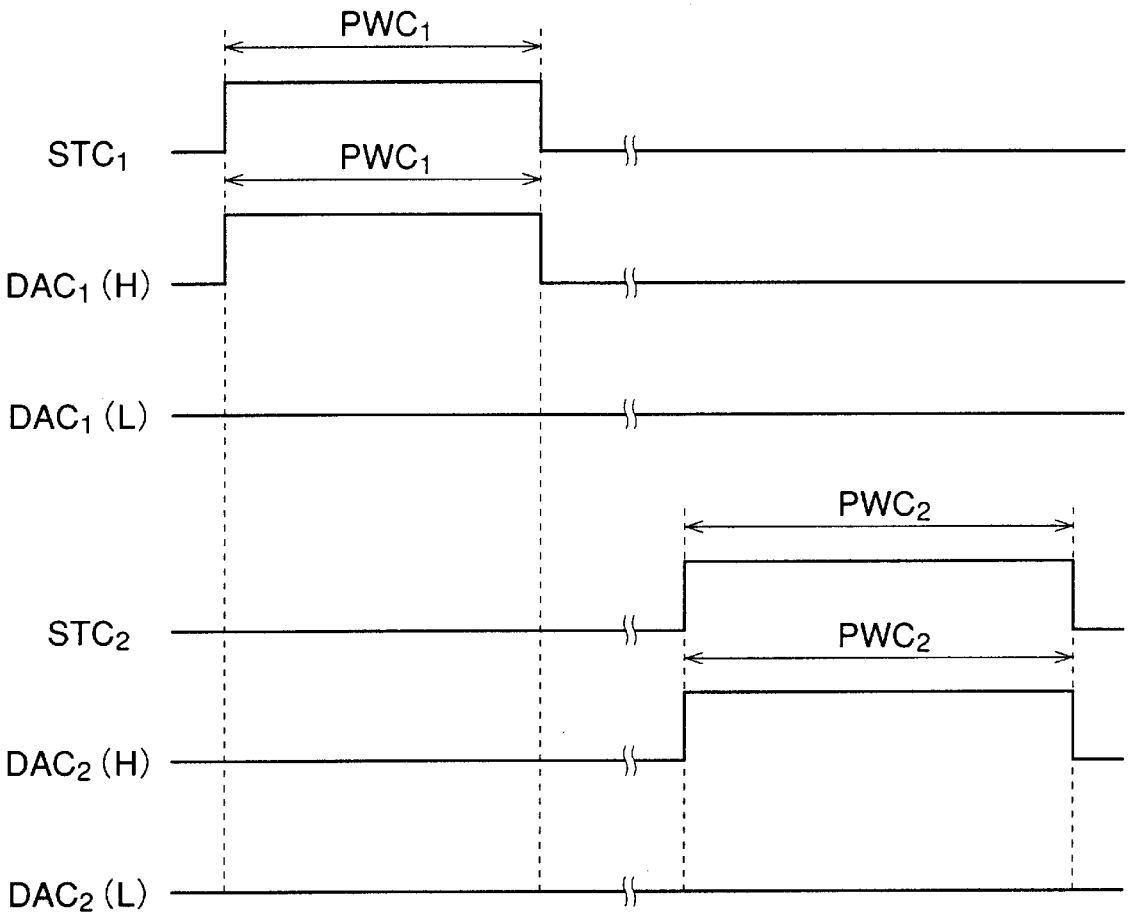
FIG. 27 is a timing chart showing a set of strobe signals and a set of control signals for electronically actuating the set of thermal head driver circuits for producing a cyan dot on the image-forming substrate of FIG. 15.
FIG. 28 is a table showing a relationship between a digital cyan image-pixel signal carrying a 2-bit gradation-signal for producing the set of control signals and a variation of the sets of control signals caused by a combination of the digital cyan image-pixel signal and the 2-bit gradation-signal.

Further, when the corresponding pair of electric resistance elements $ER_1$ and $ER_2$, as shown in FIG. 19, is one included in the third set of thermal heads 30$C_1$ and 30$C_2$, the selective and electrical energization of the electric resistance elements $ER_1$ and $ER_2$ is performed in substantially the same manner as mentioned above and shown in a timing chart of FIG. 27 and a table of FIG. 28, whereby a variation in density (gradation) of the cyan dot is obtainable.

In particular, if a digital cyan image-pixel signal "C" has a value "0", and if a 2-bit digital gradation signal "GSC" has a value [00], the electric resistance elements $ER_1$ and $ER_2$ is not electrically energized. Thus, a dot area, defined by both the electric resistance elements $ER_1$ and $ER_2$, is produced as a white dot on the image-forming sheet 10'.

If the digital cyan image-pixel signal "C" has a value "1", and if the 2-bit digital gradation signal "GSC" has a value [01], only the electric resistance element $ER_1$ is electrically energized during a period corresponding to a pulse width "$PWC_1$" of a high-level pulse of a control signal "$DAC_1$", which is equal to that of a strobe signal "$STC_1$", being longer than that of the strobe signal "$STM_2$", whereby the electric resistance element $ER_1$ is heated to the temperature between the glass-transition temperatures $TT_5$ and $TT_6$. On the other hand, the electric resistance element $ER_2$ is not electrically energized. Thus, in a dot area, defined by both the electric resistance elements $ER_1$ and $ER_2$, on the image-forming sheet 10', only the microcapsules 18$C_1$' are compacted and broken, resulting in seepage of the first type of cyan liquid dye $C_1$ from the compacted and broken microcapsules 18$C_1$'. In this case, a dot area, defined by both the electric resistance elements $ER_1$ and $ER_2$, is colored by only the first type of cyan dye $C_1$. Namely, the dot area concerned is produced as a cyan dot on the image-forming sheet 10', and the cyan dot exhibits a first cyan density resulting from only the seeped cyan dye $C_1$.

If the digital cyan image-pixel signal "C" has a value "1", and if the 2-bit digital gradation signal "GSC" has a value [10], the electric resistance element $ER_1$ is not electrically energized. On the other hand, the electric resistance element $ER_2$ is electrically energized during a period corresponding to a pulse width "$PWC_2$" of a high-level pulse of a control signal "$DAC_2$", which is equal to that of a strobe signal "$STC_2$", being longer than that of the strobe signal "$STC_1$", whereby the electric resistance element $ER_2$ is heated to the temperature between the glass-transition temperature $TT_6$ and the upper limit temperature $TT_{UL}$. Thus, in a dot area defined by both the electric resistance elements $ER_1$ and $ER_2$, only the microcapsules 18$C_2$' are compacted and broken, resulting in seepage of the second type of cyan liquid dye $C_2$ from the compacted and broken microcapsules 18$C_2$'. In this case, a dot area, defined by both the electric resistance elements $ER_1$ and $ER_2$, is colored by only the second type of cyan dye $C_2$. Namely, the dot area concerned is produced as a cyan dot on the image-forming sheet 10', and the cyan dot exhibits a second cyan density resulting from only the seeped cyan dye $C_2$.

If the digital cyan image-pixel signal "C" has a value "1", and if the 2-bit digital gradation signal "GSC" has a value [11], electrical energization of both the electric resistance elements $ER_1$ and $ER_2$ is carried out. Thus, in a dot area defined by both the electric resistance elements $ER_1$ and $ER_2$, both the microcapsules 18$C_1$' and 18$C_2$' are compacted and broken, resulting in seepage of the first and second types of cyan liquid dyes $C_1$ and $C_2$ from the compacted and broken microcapsules 18$C_1$' and 18$C_2$'. In this case, the dot area, defined by both the electric resistance elements $ER_1$ and $ER_2$, is colored by both the first and second types of cyan dyes $C_1$ and $C_2$. Namely, the dot area concerned is produced as a cyan dot on the image-forming sheet 10', and the cyan dot exhibits a third cyan density resulting from a mixture of the seeped cyan dyes $C_1$ and $C_2$.

Note, similar to the first embodiment, the yellow dot, the magenta dot and the cyan dot, produced on the image-forming sheet 10', also have a dot size of about 50 $\mu$m to about 100 $\mu$m, and the first, second, third, fourth, fifth and sixth types of microcapsules 18$Y_1$', 18$Y_2$', 18$M_1$', 18$M_2$', 18$C_1$'and 18$C_2$' are uniformly included in a dot area to be produced on the image-forming sheet 10'.

Figure 29:
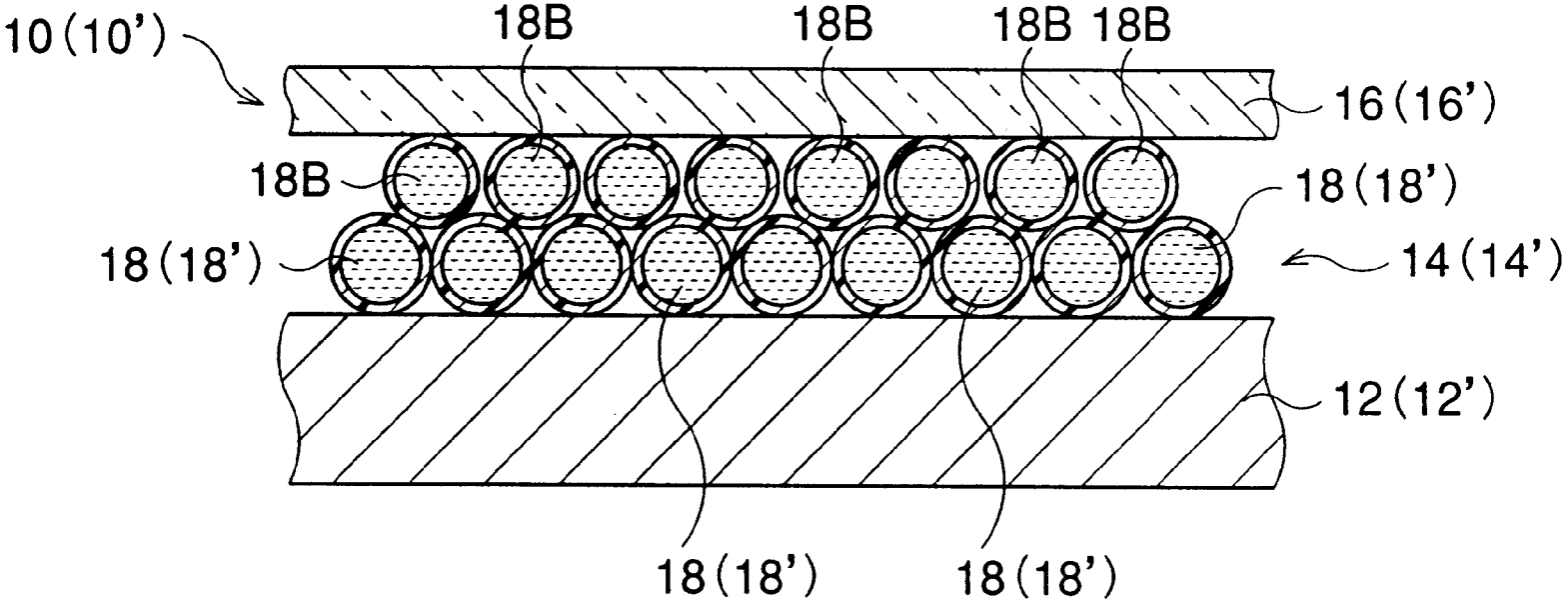
FIG. 29 is a schematic conceptual cross-sectional view showing a modification of the first and second embodiments of the image-forming substrates shown in FIGS. 1 and 15.

With reference to FIG. 29, a modification of the first and second embodiments of the image-forming sheets 10 and 10' is shown. In this modified embodiment, an additional layer of microcapsules 18B is further formed over the microcapsules layer 14 (14'), and each of the microcapsules 18B is filled with black liquid dye. Of course, the black microcapsules 18B may be produced by the same polymerization method as mentioned previously, and may have an average diameter of several microns, for example, 5 $\mu$m to 10 $\mu$m. Also, the formation of a black microcapsule layer is performed in a similar manner to the formation of the microcapsule layer 14 (14').

A microcapsule wall of each black microcapsule 18B may be formed of a suitable resin material, usually colored white, which exhibits a characteristic temperature such that it is thermally fused or plasticized when being heated to more than the upper limit temperature $T_{UL}$ or $TT_{UL}$, as shown in the graphs of FIGS. 4 and 17.

Before a color image can be formed on the image-forming sheet featuring the layer of black microcapsules 18B, a color printer, as shown in FIGS. 5 and 18, must be provided with an additional set of a line thermal head and a roller platen. The additional line thermal head is constituted such that an electric resistance element thereof is heated to more than the upper limit temperature $T_{UL}$ ($TT_{UL}$), and the additional roller platen is elastically pressed against the additional line thermal head at a pressure less than the pressure $P_1$ ($PP_1$), as shown in the graphs of FIGS. 4 and 17. When a black dot should be produced on the image-forming sheet featuring the layer of black microcapsules 18B, a corresponding electric resistance element of the additional line thermal head is electrically energized so as to be heated to the temperature beyond the upper limit temperature $T_{UL}$ ($TT_{UL}$).

As is well known, it is possible to produce black by mixing the three primary-colors: cyan, magenta and yellow, but, in reality, it is difficult to generate a true or vivid black by the mixing of the primary colors. Nevertheless, by using the image-forming sheet featuring the layer of black microcapsules 18B, it is possible to produce the true or vivid black.

Although in the embodiment above, the back microcapsules 18B is formed over an additional layer over the underlying colored capsule layer 14 or 14', these black microcaspules may also be distributed in layer 14 or 14', either in addition to, or as an alternative, to the single black layer.

In the first and second embodiments, six types of monochromatic dyes (for example, black or gray), having differing densities, may be encapsulated in the first, second, third, fourth, fifth and sixth types of microcapsules (18$Y_1$ or 18$Y_1$', 18$Y_2$ or 18$Y_2$', 18$M_1$ or 18$M_1$', 18$M_2$ or 18$M_2$', 18$C_1$ or 18$C_1$', 18$C_2$ or 18$C_2$'). In this case, of course, it is possible to produce a monochromatic dot with various differing densities (gradations).

For a dye to be encapsulated in the microcapsules (18$Y_1$ or 18$Y_1$', 18$Y_2$ or 18$Y_2$', 18$M_1$ or 18$M_1$', 18$M_2$ or 18$M_2$', 18$C_1$ or 18$C_1$', 18$C_2$ or 18$C_2$'), leuco-pigment may be utilized. As is well-known, the leuco-pigment per se exhibits no color. Accordingly, in this case, color developer is contained in the binder, which forms a part of the layer of microcapsules (14, 14').

Also, a wax-type ink may be utilized for an ink to be encapsulated in the microcapsules (18$Y_1$ or 18$Y_1$', 18$Y_2$ or 18$Y_2$', 18$M_1$ or 18$M_1$', 18$M_2$ or 18$M_2$', 18$C_1$ or 18$C_1$', 18$C_2$ or 18$C_2$'). In this case, the wax-type ink should thermally fuse at a temperature lower than a lowest critical temperature, as indicated by references $T_1$ and $TT_1$, shown in FIGS. 4 and 17, respectively.

With the enlightenment of the teachings of the present application, one of ordinary skill could select appropriate wall thickness for the microcapsules from the disclosed preferable range of 5–10 $\mu$m which shatter at the temperatures and pressureses as described herein.

Finally, it will be understood by those skilled in the art that the foregoing description is of preferred embodiments of the image-forming substrate, and that various changes and modifications may be made to the present invention without departing from the spirit and scope thereof.

By way of non-limiting example, although the present application describes the microcapsules in terms of prefered color and/or different types of capsules, the invention is not so limited. The use of any number and/or type of colors, and the mechanism necessary to shatter such number of different capsules, fall within the teachings of the present invention.

In another example, the prefered embodiment of the present application contemplates the uses of multiple colors uniformly distributed in a single layer, either alone or with an additional black/grey layer thereon. The invention is not, however, so limited. The number, type, and color of microcapsules may be provided in any number of desired layers. By way of example, the colors could be applied in layers, i.e., one specific color to a layer. In an alternative, any combination of one or more colors could appear in different layers. In a further alternative, indentical color combinations could be present in seperate layers (such as to increase density). Such combinations represent variations of the teachings herein, and thus fall within the scope and spirit of the invention.

The present disclosure relates to subject matter contained in Japanese Patent Application No. 10-69452 (filed on Mar. 4, 1998) which is expressly incorporated herein, by reference, in its entirety.

What is claimed:

1. An image-forming substrate comprising:

a base member; and a layer of microcapsules, coated over said base member, containing a first type of microcapsule filled with a first type of first-single-color dye, and a second type of microcapsule filled with a second type of first-single-color dye, said first type of microcapsule exhibiting a first temperature/pressure characteristic such that, when said first type of microcapsule is squashed under a first predetermined pressure at a first predetermined temperature, discharge of said first type of first-single-color dye from said squashed microcapsule occurs, said second type of microcapsule exhibiting a second temperature/pressure characteristic such that, when said second type of microcapsule is squashed under said first predetermined pressure at a second predetermined temperature, discharge of said second type of first-single-color dye from said squashed microcapsule occurs.

2. An image-forming substrate as set forth in claim 1, wherein said first type of first-single-color dye exhibits a same density as that of said second type of first-single-color dye.

3. An image-forming substrate as set forth in claim 1, wherein said first type of first-single-color dye exhibits a density different from that of said second type of first-single-color dye.

4. An image-forming substrate as set forth in claim 1, wherein said layer of microcapsules further comprises a third type of microcapsule filled with a first type of second-single-color dye, and a fourth type of microcapsule filled with a second type of second-single-color dye, said third type of microcapsule exhibiting a third temperature/pressure characteristic such that, when said third type of microcapsule is squashed under a second predetermined pressure at a third predetermined temperature, discharge of said first type of second-single-color dye from said squashed microcapsule occurs, said fourth type of microcapsule exhibiting a fourth temperature/pressure characteristic such that, when said fourth type of microcapsule is squashed under said second predetermined pressure at a fourth predetermined temperature, discharge of said second type of second-single-color dye from said squashed microcapsule occurs.

5. An image-forming substrate as set forth in claim 4, wherein said first type of second-single-color dye exhibits a same density as that of said second type of second-single-color dye.

6. An image-forming substrate as set forth in claim 4, wherein said first type of second-single-color dye exhibits a density different from that of said second type of second-single-color dye.

7. An image-forming substrate as set forth in claim 4, wherein said layer of microcapsules further comprises a fifth type of microcapsule filled with a first type of third-single-color dye, and a sixth type of microcapsule filled with a second type of third-single-color dye, said fifth type of microcapsule exhibiting a fifth temperature/pressure characteristic such that, when said fifth type of microcapsule is squashed under a third predetermined pressure at a fifth predetermined temperature, discharge of said first type of third-single-color dye from said squashed microcapsule occurs, said sixth type of microcapsule exhibiting a sixth temperature/pressure characteristic such that, when said sixth type of microcapsule is squashed under said third predetermined pressure at a sixth predetermined temperature, discharge of said second type of third-single-color dye from said squashed microcapsule occurs.

8. An image-forming substrate as set forth in claim 7, wherein said first type of third-single-color dye exhibits a same density as that of said second type of third-single-color dye.

9. An image-forming substrate as set forth in claim 7, wherein said first type of third-single-color dye exhibits a density different from that of said second type of third-single-color dye.

10. An image-forming substrate as set forth in claim 7, wherein said first-single-color dye, said second-single-color dye and said third-single-color dye comprise three-primary color dyes.

11. An image-forming substrate as set forth in claim 10, further comprising an additional layer of microcapsules filled with black dye coated over said layer of microcapsules, said microcapsules included in said additional layer of microcapsules being formed of resin such that they are thermally plasticized at a greater temperature than said sixth predetermined temperature and under a lower pressure than said third predetermined pressure.

12. An image-forming substrate as set forth in claim 7, wherein said first-single-color dye, said second-single-color dye and said third-single-color dye comprise a same single-color dye exhibiting differing densities.

13. An image-forming apparatus using said image-forming substrate as set forth in claim 7, which comprises:

a first pressure applicator that exerts said first predetermined pressure on said image-forming substrate;

a second pressure applicator that exerts said second predetermined pressure on said image-forming substrate;

a third pressure applicator that exerts said third predetermined pressure on said image-forming substrate;

a first thermal heater that selectively heats a localized area, on which said first predetermined pressure is exerted by said first pressure applicator, to one of said first predetermined temperature and said second predetermined temperature in accordance with first-single-color image-pixel information carrying gradation information;

a second thermal heater that selectively heats a localized area, on which said second predetermined pressure is exerted by said second pressure applicator, to one of said third predetermined temperature and said fourth predetermined temperature in accordance with second-single-color image-pixel information carrying gradation information; and a third thermal heater that selectively heats a localized area, on which said third predetermined pressure is exerted by said third pressure applicator, to one of said fifth predetermined temperature and said sixth predetermined temperature in accordance with third-single-color image-pixel information carrying gradation information.

14. An image-forming apparatus using said image-forming substrate as set forth in claim 4, which comprises:

a first pressure applicator that exerts said first predetermined pressure on said image-forming substrate;

a second pressure applicator that exerts said second predetermined pressure on said image-forming substrate;

a first thermal heater that selectively heats a localized area, on which said first predetermined pressure is exerted by said first pressure applicator, to one of said first predetermined temperature and said second predetermined temperature in accordance with first-single-color image-pixel information carrying gradation information; and a second thermal heater that selectively heats a localized area, on which said second predetermined pressure is exerted by said second pressure applicator, to one of said third predetermined temperature and said fourth predetermined temperature in accordance with second-single-color image-pixel information carrying gradation information.

15. An image-forming apparatus using said image-forming substrate as set forth in claim 1, which comprises:

a pressure applicator that exerts said first predetermined pressure on said image-forming substrate; and a thermal heater that selectively heats a localized area, on which said first predetermined pressure is exerted by said first pressure applicator, to one of said first predetermined temperature and said second predetermined temperature in accordance with image-pixel information carrying gradation information.

16. An image-forming substrate comprising:

a base member; and a layer of microcapsules, coated over said base member, containing a first type of microcapsule filled with a first type of first-single-color dye, and a second type of microcapsule filled with a first type of first-single-color dye, said first type of microcapsule exhibiting a first temperature/pressure characteristic such that, when said first type of microcapsule is squashed under a first predetermined pressure at a first predetermined temperature, discharge of said first type of first-single-color dye from said squashed microcapsule occurs, said second type of microcapsule exhibiting a second temperature/pressure characteristic such that, when said second type of microcapsule is squashed under a second predetermined pressure at a second predetermined temperature, discharge of said second type of first-single-color dye from said squashed microcapsule occurs.

17. An image-forming substrate as set forth in claim 16, wherein said layer of microcapsules further comprises a third type of microcapsule filled with a first type of second-single-color dye, and a fourth type of microcapsule filled with a second type of second-single-color dye, said third type of microcapsule exhibiting a third temperature/pressure characteristic such that, when said third type of microcapsule is squashed under a third predetermined pressure at a third predetermined temperature, discharge of said first type of second-single-color dye from said squashed microcapsule occurs, said fourth type of microcapsule exhibiting a fourth temperature/pressure characteristic such that, when said fourth type of microcapsule is squashed under a fourth predetermined pressure at a fourth predetermined temperature, discharge of said second type of second-single-color dye from said squashed microcapsule occurs.

18. An image-forming substrate as set forth in claim 17, wherein said layer of microcapsules further comprises a fifth type of microcapsule filled with a first type of third-single-color dye, and a sixth type of microcapsule filled with a second type of third-single-color dye, said fifth type of microcapsule exhibiting a fifth temperature/pressure characteristic such that, when said fifth type of microcapsule is squashed under a fifth predetermined pressure at a fifth predetermined temperature, discharge of said first type of third-single-color dye from said squashed microcapsule occurs, said sixth type of microcapsule exhibiting a sixth temperature/pressure characteristic such that, when said sixth type of microcapsule is squashed under a sixth predetermined pressure at a sixth predetermined temperature, discharge of said second type of third-single-color dye from said squashed microcapsule occurs.

19. An image-forming substrate as set forth in claim 18, wherein said first-single-color dye, said second-single-color dye and said third-single-color dye comprises three-primary color dyes.

20. An image-forming substrate as set forth in claim 19, further comprising an additional layer of microcapsules filled with black dye coated over said layer of microcapsules, said microcapsules included in said additional layer of microcapsules being formed of resin such that they are thermally plasticized at a greater temperature than said sixth predetermined temperature and under a lower pressure than said sixth predetermined pressure.

21. An image-forming substrate as set forth in claim 18, wherein said first-single-color dye, said second-single-color dye and said third-single-color dye comprise a same single-color dye exhibiting differing densities.

22. An image-forming apparatus using said image-forming substrate as set forth in claim 18, which comprises:

a first pressure applicator that exerts said first predetermined pressure on said image-forming substrate;

a second pressure applicator that exerts said second predetermined pressure on said image-forming substrate;

a third pressure applicator that exerts said third predetermined pressure on said image-forming substrate;

a fourth pressure applicator that exerts said fourth predetermined pressure said image-forming substrate;

a fifth pressure applicator that exerts said fifth predetermined pressure on said image-forming substrate;

a sixth pressure applicator that exerts said sixth predetermined pressure on said image-forming substrate;

a first thermal heater that selectively heats a localized area, on which said first predetermined pressure is exerted by said pressure applicator, to said first predetermined temperature in accordance with first-single-color image-pixel information carrying gradation information;

a second thermal heater that selectively heats a localized area, on which said second predetermined pressure is exerted by said second pressure applicator, to said second predetermined temperature in accordance with said first-single-color image-pixel information carrying said gradation information;

a third thermal heater that selectively heats a localized area, on which said third predetermined pressure is exerted by said third pressure applicator, to said third predetermined temperature in accordance with second-single-color image-pixel information carrying gradation information;

a fourth thermal heater that selectively heats a localized area, on which said fourth predetermined pressure is exerted by said fourth pressure applicator, to said fourth predetermined temperature in accordance with said second-single-color image-pixel information carrying said gradation information;

a fifth thermal heater that selectively heats a localized area, on which said fifth predetermined pressure is exerted by said fifth pressure applicator, to said fifth predetermined temperature in accordance with third-single-color image-pixel information carrying gradation information; and a sixth thermal heater that selectively heats a localized area, on which said sixth predetermined pressure is exerted by said sixth pressure applicator, to said sixth predetermined temperature in accordance with said third-single-color image-pixel information carrying said gradation information.

23. An image-forming apparatus using said image-forming substrate as set forth in claim 17, which comprises:

a first pressure applicator that exerts said first predetermined pressure on said image-forming substrate;

a second pressure applicator that exerts said second predetermined pressure on said image-forming substrate;

a third pressure applicator that exerts said third predetermined pressure on said image-forming substrate;

a fourth pressure applicator that exerts said fourth predetermined pressure on said image-forming substrate;

a first thermal heater that selectively heats a localized area, on which said first predetermined pressure is exerted by said first pressure applicator, to said first predetermined temperature in accordance with first-single-color image-pixel information carrying gradation information;

a second thermal heater that selectively heats a localized area, on which said second predetermined pressure is exerted by said second pressure applicator, to said second predetermined temperature in accordance with said first-single-color image-pixel information carrying said gradation information;

a third thermal heater that selectively heats a localized area, on which said third predetermined pressure is exerted by said third pressure applicator, to said third predetermined temperature in accordance with second-single-color image-pixel information carrying gradation information; and a fourth thermal heater that selectively heats a localized area, on which said fourth predetermined pressure is exerted by said fourth pressure applicator, to said fourth predetermined temperature in accordance with said second-single-color image-pixel information carrying said gradation information.

24. An image-forming apparatus using said image-forming substrate as set forth in claim 16, which comprises:

a first pressure applicator that exerts said first predetermined pressure on said image-forming substrate;

a second pressure applicator that exerts said second predetermined pressure on said image-forming substrate;

a first thermal heater that selectively heats a localized area, on which said first predetermined pressure is exerted by said first pressure applicator, to said first predetermined temperature in accordance with first-single-color image-pixel information carrying gradation information; and a second thermal heater that selectively heats a localized area, on which said second predetermined pressure is exerted by said second pressure applicator, to said second predetermined temperature in accordance with said first-single-color image-pixel information carrying said gradation information.

* * * * *